US010837666B2

(12) United States Patent
Thiébaux et al.

(10) Patent No.: US 10,837,666 B2
(45) Date of Patent: Nov. 17, 2020

(54) CONTROLLING OPERATION OF ENERGY-CONSUMING DEVICES

(71) Applicant: NATIONAL ICT AUSTRALIA LIMITED, Eveleigh (AU)

(72) Inventors: Sylvie Thiébaux, Eveleigh (AU); Boon-Ping Lim, Eveleigh (AU); Pascal Van Hentenryck, Eveleigh (AU); Menkes Van Den Briel, Eveleigh (AU)

(73) Assignee: NATIONAL ICT AUSTRALIA LIMITED, New South Wales (AU)

( * ) Notice: Subject to any disclaimer, the term of this patent is extended or adjusted under 35 U.S.C. 154(b) by 452 days.

(21) Appl. No.: 14/811,496

(22) Filed: Jul. 28, 2015

(65) Prior Publication Data

US 2017/0003043 A1 Jan. 5, 2017

(30) Foreign Application Priority Data

Jul. 1, 2015 (AU) ..... 2015203702

(51) Int. Cl.
*F24F 11/30* (2018.01)
*F24F 11/62* (2018.01)
*F24F 11/46* (2018.01)

(52) U.S. Cl.
CPC ..... *F24F 11/30* (2018.01); *F24F 11/62* (2018.01); *F24F 11/46* (2018.01)

(58) Field of Classification Search
CPC ... F24F 11/006; F24F 2011/0061–0065; F24F 2011/0075; G05B 17/02
(Continued)

(56) References Cited

U.S. PATENT DOCUMENTS 5,344,068 A 9/1994 Haessig
7,130,719 B2 10/2006 Ehlers et al.
(Continued)

FOREIGN PATENT DOCUMENTS

WO WO 2013/022900 2/2013
WO WO 2014/059123 4/2014
(Continued)

OTHER PUBLICATIONS

Muller, Laurent Flindt. "An adaptive large neighborhood search algorithm for the resource-constrained project scheduling problem." MIC 2009: The VIII Metaheuristics international conference. 2009.*
(Continued)

*Primary Examiner* — James J Lee
*Assistant Examiner* — Shon G Foley

(57) ABSTRACT

There is provided a computer-implemented method for controlling operation of a plurality of devices of a facility that consume energy. The method comprises obtaining parameters of an energy model representing the energy consumed by the plurality of devices of the facility, the energy model including a first plurality of variables for operating the plurality of devices and a second plurality of variables for scheduling activities to be conducted in the facility; receiving requests for the activities to be conducted in the facility, the requests including requirements in relation to the activities; and automatically determining, based on the energy model, values of the first plurality of variables to control the operation of the plurality of devices, and values of the second plurality of variables that meet the requirements in relation to the activities.

16 Claims, 16 Drawing Sheets

600

(58) Field of Classification Search
USPC ..... 700/19
See application file for complete search history.

(56) References Cited

U.S. PATENT DOCUMENTS

| | | | | |
|---|---|---|---|---|
| 8,676,394 | B2 | 3/2014 | Lo et al. | |
| 8,788,448 | B2 | 7/2014 | Fadell et al. | |
| 8,843,238 | B2 | 9/2014 | Wenzel et al. | |
| 2008/0082183 | A1 | 4/2008 | Judge | |
| 2009/0058985 | A1* | 3/2009 | Wright | H04N 7/15 348/14.08 |
| 2012/0067560 | A1 | 3/2012 | Bergman et al. | |
| 2012/0316914 | A1* | 12/2012 | Lee | G06Q 10/06 705/7.24 |
| 2013/0151012 | A1 | 6/2013 | Shetty et al. | |
| 2013/0231792 | A1 | 9/2013 | Ji et al. | |
| 2013/0274940 | A1* | 10/2013 | Wei | G05B 19/02 700/291 |
| 2014/0031989 | A1 | 1/2014 | Bergman et al. | |
| 2014/0058567 | A1 | 2/2014 | Matsuoka et al. | |
| 2014/0236360 | A1* | 8/2014 | Matsuoka | H04L 12/2825 700/276 |
| 2014/0278165 | A1* | 9/2014 | Wenzel | G06Q 50/08 702/61 |
| 2014/0330611 | A1* | 11/2014 | Steven | G06Q 10/06314 705/7.24 |
| 2015/0060037 | A1* | 3/2015 | Norrell | F24F 13/1426 165/212 |
| 2016/0061469 | A1* | 3/2016 | Albonesi | H02J 3/14 700/276 |
| 2016/0091904 | A1* | 3/2016 | Horesh | F24F 11/0034 700/276 |
| 2016/0209064 | A1* | 7/2016 | Hrejsa | F24F 11/006 |

FOREIGN PATENT DOCUMENTS

| | | |
|---|---|---|
| WO | WO 2014/122587 | 8/2014 |
| WO | WO 2014/140183 | 9/2014 |
| WO | WO 2014/153552 | 9/2014 |

OTHER PUBLICATIONS

Kwak, J., Varakanthann, P., Maheswaran, R. et al. Auton Agent Multi-Agent Syst (2014) 28: 605. https://doi.org/10.1007/s10458-013-9234-0 (Year: 2013).*

Abhinandan Majunndar et al. 2012. Energy-aware meeting scheduling algorithms for smart buildings. In Proceedings of the Fourth ACM Workshop on Embedded Sensing Systems for Energy-Efficiency in Buildings (BuildSys '12) ACM New York, NY, USA, 161-168 (Year: 2012).*

Godard, Daniel, Philippe Laborie and Wim Nuijten. "Randomized Large Neighborhood Search for Cumulative Scheduling." ICAPS (2005) (Year: 2005).*

* cited by examiner

100

200

300

400

500

600

700

800

900

HVAC System Parameters

- HVAC_TURN_ON = "06:00" # Turn on time
- HVAC_SHUT_DOWN = "18:00" # Shut down time

- INITIAL_TEMPERATURE = 25 # Assumed standard initial temperature for all zone.
- TEMPERATURE_UNOCC_MIN = 12.8 # Minimum zone temperature allowed during unoccupied in Celsius
- TEMPERATURE_OCC_COMFORT_RANGE_INCR = 8.2 # Given TEMPERATURE_UNOCC_MIN, the range of temperature in Celsius to increase when location is occupied in order to achieve comfort temperature
- TEMPERATURE_UNOCC_MAX = 40 # Maximum zone temperature allowed during unoccupied in Celsius
- TEMPERATURE_OCC_COMFORT_RANGE_DECR = 19 # Given TEMPERATURE_UNOCC_MAX, the range of temperature to be decreased in order to achieve comfort temperature
- TEMPERATURE_CONDITIONED_AIR = 12.8 # Conditioned air temperature in Celsius.
- TEMPERATURE_SUPPLY_AIR_HIGH = 40 # Maximum supply air temperature in Celsius

- BETA_FAN_POWER_CONSTANT = 0.65 # Fan power constant
- AIR_HEAT_CAPACITY_AT_CONSTANT_PRESSURE = 1.005 # Specific heat capacity at constant pressure in kJ/(kg x Celsius)
- MASS_AIR_FLOW_SUPPLY_AIR_MIN = 0 # Minimum amount of supply air required in kg/s
- MASS_AIR_FLOW_SUPPLY_AIR_MAX = 1 # Maximum amount of supply air required in kg/s

- OCCUPANT_SENSIBLE_HEAT_GAIN = 75 # Assumed standard occupant sensible heat gain in W
- OUTDOOR_TEMP_DATA = "Data/Weathers/EP_CBR" # Outdoor temperature data (a.k.a estimated outdoor temperature from weather station)
- SCHEDULING_START_DATETIME = "2011-01-07 00:00" # Starting date and time for meeting scheduling
- SCHEDULING_END_DATETIME = "2011-01-07 23:30" # Ending data and time for meeting scheduling
- SCHEDULING_INTERVAL = 30 # Scheduling timestep in minutes

FIG. 7(d)

1000

Meeting Requests

```
[m1]
Attendees = 101, 102, 103, 104, 105, 106, 107, 108, 109,
            110,111,112,113,114,115
Duration=4
[[W1]]
        Start=2011-01-07 09:00
        End=2011-01-07 17:00

[m2]
Attendees = 201, 202, 203, 204, 205, 206, 207, 208, 209, 210
Duration=4
[[W1]]
        Start=2011-01-07 09:00
        End=2011-01-07 17:00
```

FIG. 7(e)

1100

Meeting Schedule 1101 | HVAC operation 1103 | Energy Consumption 1105

| Time | Room Allocation | | Supply Air Flow Rate (kg/s) | Supply Air Temperature (Celsius) | Energy (kWh) | Room Temperature (Celsius) |
|---|---|---|---|---|---|---|
| | R1 | R2 | $\alpha_{l,k}^{SA}$ | $T_{l,k}^{SA}$ | e | |
| 1/7/2011 0:00 | | | 0.0, 0.0 | 0.0, 0.0 | 0.0 | 25.0, 25.0 |
| 1/7/2011 0:30 | | | 0.0, 0.0 | 0.0, 0.0 | 0.0 | 24.81, 24.81 |
| | | | ..... | | | |
| 1/7/2011 5:00 | | | 0.0, 0.0 | 0.0, 0.0 | 0.0 | 22.49, 22.49 |
| 1/7/2011 5:30 | | | 0.0, 0.0 | 0.0, 0.0 | 0.0 | 22.27, 22.27 |
| 1/7/2011 6:00 | | | 0.11, 0.16 | 12.8, 12.8 | 0.18 | 22.1, 22.16 |
| 1/7/2011 6:30 | | | 0.04, 0.04 | 12.8, 12.8 | 0.08 | 16.44, 12.8 |
| 1/7/2011 7:00 | | | 0.04, 0.04 | 12.8, 12.8 | 0.12 | 19.68, 19.15 |
| 1/7/2011 7:30 | | | 0.04, 0.04 | 12.8, 12.8 | 0.15 | 20.25, 20.47 |
| 1/7/2011 8:00 | | | 0.04, 0.04 | 12.8, 12.8 | 0.19 | 20.5, 21.13 |
| 1/7/2011 8:30 | | | 0.04, 0.06 | 12.8, 12.8 | 0.27 | 20.73, 21.68 |
| 1/7/2011 9:00 | M1 | M2 | 0.04, 0.06 | 12.8, 12.8 | 0.34 | 21.0, 21.0 |
| 1/7/2011 9:30 | M1 | M2 | 0.05, 0.06 | 12.8, 12.8 | 0.41 | 21.0, 21.0 |
| 1/7/2011 10:00 | M1 | M2 | 0.05, 0.06 | 12.8, 12.8 | 0.48 | 21.0, 21.0 |
| 1/7/2011 10:30 | M1 | M2 | 0.04, 0.04 | 12.8, 12.8 | 0.36 | 21.0, 21.0 |
| 1/7/2011 11:00 | | | 0.04, 0.04 | 12.8, 12.8 | 0.4 | 21.98, 22.81 |
| 1/7/2011 11:30 | | | 0.04, 0.04 | 12.8, 12.8 | 0.43 | 22.43, 23.37 |
| 1/7/2011 12:00 | | | 0.04, 0.04 | 12.8, 12.8 | 0.47 | 22.8, 23.73 |
| 1/7/2011 12:30 | | | 0.04, 0.04 | 12.8, 12.8 | 0.5 | 23.15, 24.03 |
| 1/7/2011 13:00 | | | 0.04, 0.04 | 12.8, 12.8 | 0.53 | 23.52, 24.32 |
| 1/7/2011 13:30 | | | 0.04, 0.04 | 12.8, 12.8 | 0.57 | 23.92, 24.6 |
| 1/7/2011 14:00 | | | 0.04, 0.04 | 12.8, 12.8 | 0.6 | 24.33, 24.89 |
| | | | ..... | | | |

FIG. 7(f)

| Strategy | Average energy consumption (kWh) | Excess consumption vs. baseline |
|---|---|---|
| AN | 212.14 | 74.84% |
| AS | 199.94 | 64.78% |
| HN | 184.26 | 51.86% |
| HS | 177.32 | 46.14% |
| ON | 124.13 | 2.30% |
| OS | 121.34 | baseline |

1400

Meeting Schedule 1401

HVAC operation 1403

Energy Consumption 1405

| Time | Room Allocation | | | | Supply Air Flow Rate (kg/s) | Supply Air Temperature (Celcius) | Energy (kWh) |
|---|---|---|---|---|---|---|---|
| | R0 | R1 | R2 | R3 | | | |
| 1/7/2011 6:00 | | | | | 0.04, 0.04, 0.14, 0.04 | 12.8, 12.8, 12.8, 12.8 | 0.16 |
| 1/7/2011 6:30 | | | | | 0.04, 0.04, 0.09, 0.04 | 12.8, 12.8, 12.8, 12.8 | 0.23 |
| 1/7/2011 7:00 | | | | | 0.04, 0.04, 0.13, 0.04 | 12.8, 12.8, 12.8, 12.8 | 0.37 |
| 1/7/2011 7:30 | | | | | 0.04, 0.04, 0.04, 0.04 | 12.8, 12.8, 12.8, 12.8 | 0.31 |
| 1/7/2011 8:00 | | | | | 0.04, 0.04, 0.04, 0.04 | 12.8, 12.8, 12.8, 12.8 | 0.38 |
| 1/7/2011 8:30 | | | | | 0.04, 0.04, 0.04, 0.04 | 12.8, 12.8, 12.8, 12.8 | 0.44 |
| 1/7/2011 9:00 | | | | | 0.04, 0.04, 0.04, 0.04 | 12.8, 12.8, 12.8, 12.8 | 0.51 |
| 1/7/2011 9:30 | | | | | 0.04, 0.04, 0.04, 0.04 | 12.8, 12.8, 12.8, 12.8 | 0.58 |
| 1/7/2011 10:00 | | | | | 0.04, 0.04, 0.04, 0.04 | 12.8, 12.8, 12.8, 12.8 | 0.65 |
| 1/7/2011 10:30 | | | | | 0.04, 0.04, 0.04, 0.04 | 12.8, 12.8, 12.8, 12.8 | 0.73 |
| 1/7/2011 11:00 | | | | | 0.04, 0.04, 0.04, 0.04 | 12.8, 12.8, 12.8, 12.8 | 0.8, |
| 1/7/2011 11:30 | | | | | 0.04, 0.04, 0.04, 0.04 | 12.8, 12.8, 12.8, 12.8 | 0.87 |
| 1/7/2011 12:00 | | | | | 0.04, 0.04, 0.04, 0.04 | 12.8, 12.8, 12.8, 12.8 | 0.93 |
| 1/7/2011 12:30 | | | | | 0.04, 0.04, 0.07, 0.04 | 12.8, 12.8, 12.8, 12.8 | 1.18 |
| 1/7/2011 13:00 | | | M1 | | 0.04, 0.04, 0.06, 0.04 | 12.8, 12.8, 12.8, 12.8 | 1.25 |
| 1/7/2011 13:30 | | | M1 | | 0.04, 0.04, 0.07, 0.04 | 12.8, 12.8, 12.8, 12.8 | 1.35 |
| 1/7/2011 14:00 | | | M2 | | 0.04, 0.04, 0.07, 0.04 | 12.8, 12.8, 12.8, 12.8 | 1.45 |
| 1/7/2011 14:30 | | | M2 | | 0.04, 0.04, 0.07, 0.04 | 12.8, 12.8, 12.8, 12.8 | 1.54 |
| 1/7/2011 15:00 | | | | | 0.04, 0.04, 0.07, 0.04 | 12.8, 12.8, 12.8, 12.8 | 1.5 |
| 1/7/2011 15:30 | | | M3 | | 0.04, 0.04, 0.07, 0.04 | 12.8, 12.8, 12.8, 12.8 | 1.44 |
| 1/7/2011 16:00 | | | M3 | | 0.04, 0.04, 0.08, 0.04 | 12.8, 12.8, 12.8, 12.8 | 1.39 |
| 1/7/2011 16:30 | | | M4 | | 0.04, 0.04, 0.04, 0.04 | 12.8, 12.8, 12.8, 12.8 | 1.06 |
| 1/7/2011 17:00 | | | M4 | | 0.04, 0.04, 0.04, 0.04 | 12.8, 12.8, 12.8, 12.8 | 1.02 |
| 1/7/2011 17:30 | | | | | 0.04, 0.04, 0.04, 0.04 | 12.8, 12.8, 12.8, 12.8 | 0.97 |

FIG. 10(a)

1500

Meeting Schedule 1401

HVAC operation 1403

Energy Consumption 1405

| Time | Room Allocation | | | | Supply Air Flow Rate (kg/s) | Supply Air Temperature (Celcius) | Energy (kWh) |
|---|---|---|---|---|---|---|---|
| | R0 | R1 | R2 | R3 | | | |
| 1/7/2011 6:00 | | | | | 0.04, 0.14, 0.04, 0.04 | 12.8, 12.8, 12.8, 12.8 | 0.17 |
| 1/7/2011 6:30 | | | | | 0.04, 0.1, 0.04, 0.04 | 12.8, 12.8, 12.8, 12.8 | 0.23 |
| 1/7/2011 7:00 | | | | | 0.04, 0.13, 0.04, 0.04 | 12.8, 12.8, 12.8, 12.8 | 0.39 |
| 1/7/2011 7:30 | | | | | 0.04, 0.04, 0.04, 0.04 | 12.8, 12.8, 12.8, 12.8 | 0.31 |
| 1/7/2011 8:00 | | | | | 0.04, 0.04, 0.04, 0.04 | 12.8, 12.8, 12.8, 12.8 | 0.38 |
| 1/7/2011 8:30 | | | | | 0.04, 0.04, 0.04, 0.04 | 12.8, 12.8, 12.8, 12.8 | 0.44 |
| 1/7/2011 9:00 | | M1 | | | 0.04, 0.05, 0.04, 0.04 | 12.8, 12.8, 12.8, 12.8 | 0.54 |
| 1/7/2011 9:30 | | M1 | | | 0.04, 0.05, 0.04, 0.04 | 12.8, 12.8, 12.8, 12.8 | 0.64 |
| 1/7/2011 10:00 | | M2 | | | 0.04, 0.06, 0.04, 0.04 | 12.8, 12.8, 12.8, 12.8 | 0.73 |
| 1/7/2011 10:30 | | M2 | | | 0.04, 0.06, 0.04, 0.04 | 12.8, 12.8, 12.8, 12.8 | 0.83 |
| 1/7/2011 11:00 | | M3 | | | 0.04, 0.06, 0.04, 0.04 | 12.8, 12.8, 12.8, 12.8 | 0.92 |
| 1/7/2011 11:30 | | M3 | | | 0.04, 0.06, 0.04, 0.04 | 12.8, 12.8, 12.8, 12.8 | 1.0 |
| 1/7/2011 12:00 | | M4 | | | 0.04, 0.06, 0.04, 0.04 | 12.8, 12.8, 12.8, 12.8 | 1.09 |
| 1/7/2011 12:30 | | M4 | | | 0.04, 0.04, 0.04, 0.04 | 12.8, 12.8, 12.8, 12.8 | 1.0 |
| 1/7/2011 13:00 | | | | | 0.04, 0.04, 0.04, 0.04 | 12.8, 12.8, 12.8, 12.8 | 1.06 |
| 1/7/2011 13:30 | | | | | 0.04, 0.04, 0.04, 0.04 | 12.8, 12.8, 12.8, 12.8 | 1.13 |
| 1/7/2011 14:00 | | | | | 0.04, 0.04, 0.04, 0.04 | 12.8, 12.8, 12.8, 12.8 | 1.2 |
| 1/7/2011 14:30 | | | | | 0.04, 0.04, 0.04, 0.04 | 12.8, 12.8, 12.8, 12.8 | 1.26 |
| 1/7/2011 15:00 | | | | | 0.04, 0.04, 0.04, 0.04 | 12.8, 12.8, 12.8, 12.8 | 1.21 |
| 1/7/2011 15:30 | | | | | 0.04, 0.04, 0.04, 0.04 | 12.8, 12.8, 12.8, 12.8 | 1.16 |
| 1/7/2011 16:00 | | | | | 0.04, 0.04, 0.04, 0.04 | 12.8, 12.8, 12.8, 12.8 | 1.11 |
| 1/7/2011 16:30 | | | | | 0.04, 0.04, 0.04, 0.04 | 12.8, 12.8, 12.8, 12.8 | 1.06 |
| 1/7/2011 17:00 | | | | | 0.04, 0.04, 0.04, 0.04 | 12.8, 12.8, 12.8, 12.8 | 1.02 |
| 1/7/2011 17:30 | | | | | 0.04, 0.04, 0.04, 0.04 | 12.8, 12.8, 12.8, 12.8 | 0.97 |

FIG. 10(b)

1600

Meeting Schedule 1401

HVAC operation 1403

Energy Consumption 1405

| Time | Room Allocation | | | | Supply Air Flow Rate (kg/s) | Supply Air Temperature (Celcius) | Energy (kWh) |
|---|---|---|---|---|---|---|---|
| | R0 | R1 | R2 | R3 | | | |
| 1/7/2011 6:00 | | | | | 0.11, 0.04, 0.11, 0.04 | 12.8, 12.8, 12.8, 12.8 | 0.19 |
| 1/7/2011 6:30 | | | | | 0.04, 0.04, 0.04, 0.04 | 12.8, 12.8, 12.8, 12.8 | 0.17 |
| 1/7/2011 7:00 | | | | | 0.04, 0.04, 0.04, 0.04 | 12.8, 12.8, 12.8, 12.8 | 0.24 |
| 1/7/2011 7:30 | | | | | 0.04, 0.04, 0.04, 0.04 | 12.8, 12.8, 12.8, 12.8 | 0.31 |
| 1/7/2011 8:00 | | | | | 0.04, 0.04, 0.04, 0.04 | 12.8, 12.8, 12.8, 12.8 | 0.38 |
| 1/7/2011 8:30 | | | | | 0.04, 0.04, 0.04, 0.04 | 12.8, 12.8, 12.8, 12.8 | 0.44 |
| 1/7/2011 9:00 | M1 | | M3 | | 0.04, 0.04, 0.04, 0.04 | 12.8, 12.8, 12.8, 12.8 | 0.54 |
| 1/7/2011 9:30 | M1 | | M3 | | 0.05, 0.04, 0.05, 0.04 | 12.8, 12.8, 12.8, 12.8 | 0.64 |
| 1/7/2011 10:00 | M2 | | M4 | | 0.05, 0.04, 0.05, 0.04 | 12.8, 12.8, 12.8, 12.8 | 0.75 |
| 1/7/2011 10:30 | M2 | | M4 | | 0.04, 0.04, 0.04, 0.04 | 12.8, 12.8, 12.8, 12.8 | 0.73 |
| 1/7/2011 11:00 | | | | | 0.04, 0.04, 0.04, 0.04 | 12.8, 12.8, 12.8, 12.8 | 0.8 |
| 1/7/2011 11:30 | | | | | 0.04, 0.04, 0.04, 0.04 | 12.8, 12.8, 12.8, 12.8 | 0.87 |
| 1/7/2011 12:00 | | | | | 0.04, 0.04, 0.04, 0.04 | 12.8, 12.8, 12.8, 12.8 | 0.93 |
| 1/7/2011 12:30 | | | | | 0.04, 0.04, 0.04, 0.04 | 12.8, 12.8, 12.8, 12.8 | 1.0 |
| 1/7/2011 13:00 | | | | | 0.04, 0.04, 0.04, 0.04 | 12.8, 12.8, 12.8, 12.8 | 1.06 |
| 1/7/2011 13:30 | | | | | 0.04, 0.04, 0.04, 0.04 | 12.8, 12.8, 12.8, 12.8 | 1.13 |
| 1/7/2011 14:00 | | | | | 0.04, 0.04, 0.04, 0.04 | 12.8, 12.8, 12.8, 12.8 | 1.2 |
| 1/7/2011 14:30 | | | | | 0.04, 0.04, 0.04, 0.04 | 12.8, 12.8, 12.8, 12.8 | 1.26 |
| 1/7/2011 15:00 | | | | | 0.04, 0.04, 0.04, 0.04 | 12.8, 12.8, 12.8, 12.8 | 1.21 |
| 1/7/2011 15:30 | | | | | 0.04, 0.04, 0.04, 0.04 | 12.8, 12.8, 12.8, 12.8 | 1.16 |
| 1/7/2011 16:00 | | | | | 0.04, 0.04, 0.04, 0.04 | 12.8, 12.8, 12.8, 12.8 | 1.11 |
| 1/7/2011 16:30 | | | | | 0.04, 0.04, 0.04, 0.04 | 12.8, 12.8, 12.8, 12.8 | 1.06 |
| 1/7/2011 17:00 | | | | | 0.04, 0.04, 0.04, 0.04 | 12.8, 12.8, 12.8, 12.8 | 1.02 |
| 1/7/2011 17:30 | | | | | 0.04, 0.04, 0.04, 0.04 | 12.8, 12.8, 12.8, 12.8 | 0.97 |

FIG. 10(c)

CONTROLLING OPERATION OF ENERGY-CONSUMING DEVICES

TECHNICAL FIELD

The present invention generally relates to controlling operation of a plurality of devices of a facility that consume energy. Aspects of the invention include computer-implemented methods, software, a computer system for controlling operation of the plurality of devices of the facility.

BACKGROUND

Heating, ventilation and air-conditioning (HVAC) systems are responsible for about 50% of the energy consumption in buildings, and about 20% of total energy consumption in the USA. In 2010, HVAC electrical expenditures in the USA were around one hundred billion dollars. These high energy costs and the rising environmental pollution levels call for the development of innovative HVAC system control strategies in buildings.

Throughout this specification the word "comprise", or variations such as "comprises" or "comprising", will be understood to imply the inclusion of a stated element, integer or step, or group of elements, integers or steps, but not the exclusion of any other element, integer or step, or group of elements, integers or steps.

Any discussion of documents, acts, materials, devices, articles or the like which has been included in the present disclosure is not to be taken as an admission that any or all of these matters form part of the prior art base or were common general knowledge in the field relevant to the present disclosure as it existed before the priority date of each claim of this application.

SUMMARY

There is provided a computer-implemented method for controlling operation of a plurality of devices of a facility that consume energy, the method comprising:

obtaining parameters of an energy model representing the energy consumed by the plurality of devices of the facility, the energy model including a first plurality of variables for operating the plurality of devices and a second plurality of variables for scheduling activities to be conducted in the facility;

receiving requests for the activities to be conducted in the facility, the requests including requirements in relation to the activities; and automatically determining, based on the energy model, values of the first plurality of variables to control the operation of the plurality of devices, and values of the second plurality of variables that meet the requirements in relation to the activities.

It is an advantage of the present disclosure that the energy model includes the first plurality of variables for operating the plurality of devices and the second plurality of variables for scheduling activities to be conducted in the facility. This way, the operation of the energy-consuming devices and the activity schedule are able to be automatically determined at the same time in an integrated way to optimise energy consumption of the facility.

The method may comprise controlling the operation of the plurality of devices according to the values of the first plurality of variables such that the energy consumed by the plurality of devices is minimised.

Controlling the operation of the plurality of devices may comprise starting at least one of the plurality of devices prior to the activities to minimise the energy consumed by the plurality of devices.

The method may comprise controlling access to the facility according to the values of the second plurality of variables.

The energy model may comprise a mixed-integer non-linear programming (MINLP) model.

The energy model may comprise a mixed-integer linear programming (MILP) model that is derived from the MINLP model.

Determining the values of the first plurality of variables and the values of the second plurality of variables may comprise applying a large neighbourhood search (LNS).

Applying the LNS may comprise applying the energy model to 2 or 3 or 4 randomly selected locations of the facility to determine the values of the first plurality of variables and the values of the second plurality of variables.

Determining the values of the first plurality of variables may comprise determining one or more of air flow rates, and air temperatures supplied by the plurality of devices.

Each of the requirements may indicate one or more of the following in relation to one of the activities:

a duration;

one or more starting time windows;

one or more locations in the facilitate;

a quantity of attendees attending the activities; and identification of the attendees.

Determining the values of the second plurality of variables may comprise determining one or more of the following for the one of the activities:

a starting time within one of the one or more starting time windows; and one of the one or more locations.

Determining the values of the first plurality of variables and the values of the second plurality of variables may comprise determining the values of the first plurality of variables and the values of the second plurality of variables based on predetermined constraints on the activities.

The plurality of devices may comprise one or more air conditioners, one or more ventilation devices and one or more air control units.

The parameters of the energy model may comprise:

a heat capacity of air for the one or more air conditioners;

a ventilation coefficient of the one or more ventilation devices; and a predetermined temperature of air conditioned by the one or more air conditioners.

The parameters of the energy model may further comprise:

a lower bound for an air flow rate supplied by the one or more air control units;

an upper bound for the air flow rate supplied by the one or more air control units;

for a location in the facility where one of the activities is to be conducted, a first lower bound for an air temperature supplied by the one or more air control units;

for a location in the facility where none of the activities is to be conducted, a second lower bound for the air temperature supplied by the one or more air control units;

for a location in the facility where one of the activities is to be conducted, a first upper bound for the air temperature supplied by the one or more air control units; and for a location in the facility where none of the activities is to be conducted, a second upper bound for the air temperature supplied by the one or more air control units.

The parameters of the energy model may further comprise thermal dynamics parameters of the facilitate.

There is provided a computer software program, including machine-readable instructions, when executed by a processor, causes the processor to perform any one of the methods described above.

There is provided a computer system for controlling operation of a plurality of devices of a facility that consume energy, the computer system comprising:

a memory to store instructions; and a processor to perform the instructions from the memory, comprising:

an energy model unit to obtain parameters of an energy model representing the energy consumed by the plurality of devices of the facility, the energy model including a first plurality of variables for operating the plurality of devices and a second plurality of variables for scheduling activities to be conducted in the facility;

a facility occupancy request unit to receive requests for the activities to be conducted in the facility, the requests including requirements in relation to the activities; and a decision unit to determine, based on the energy model, values of the first plurality of variables to control the operation of the plurality of devices, and values of the second plurality of variables that meet the requirements in relation to the activities.

BRIEF DESCRIPTION OF DRAWINGS

Features of the present disclosure are illustrated by way of non-limiting examples, and like numerals indicate like elements, in which:

FIG. 10(*a*) to (*c*) illustrate a numerical example of large neighbourhood search (LNS) approach in accordance with the present disclosure;

DESCRIPTION OF EMBODIMENTS

System Description

Figure 1:
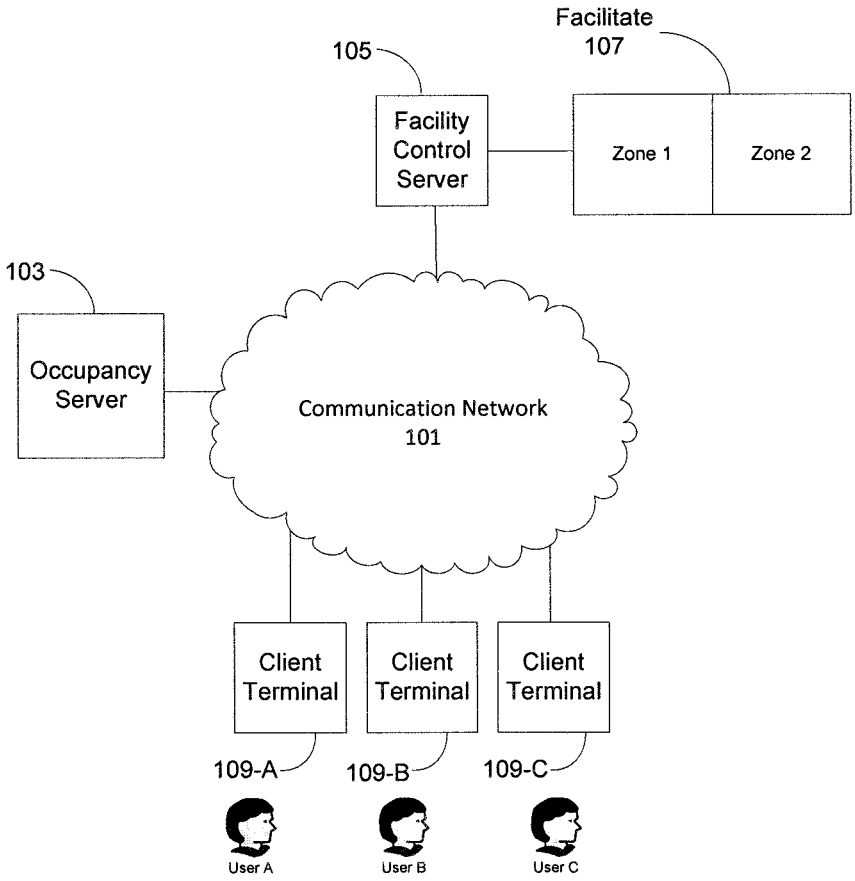
FIG. 1 illustrates a meeting room-booking system in accordance with the present disclosure.

The computer-implemented methods, computer software, and computer-systems disclosed in the present disclose are described with reference to a meeting room-booking system 100 shown in FIG. 1. However, as readily understood by a person skilled in the art after reading the present disclosure, the methods, computer software, and computer systems may be applied to other suitable scenarios without departing from the scope of the present disclosure. For example, the methods, computer software, and computer systems may also be applied to booking offices for work, class rooms for examinations or lectures, and venues for parties.

Using the meeting room-booking system 100, users A, B, C book a meeting room in a facility 107 for meetings. The facility 107 shown in FIG. 1 is a building with multiple locations or zones 1, 2. Each of the zones 1, 2 serves as a meeting room in which the meetings are held. For the comfort of attendees, a heating, ventilation, and air-conditioning (HVAC) system 300 (not shown in FIG. 1) of the facility 107 supplies a comfortable air flow with a suitable air flow rate and temperature to the zones 1, 2 to keep the zones 1, 2 at comfortable conditions for the meetings. The HVAC system 300 will be described in detail with reference to FIG. 3. It should be noted that the zones 1, 2 of the facility 107 are described as in-door areas in the facility 107 (for example, by using the terms "room" or "meeting room") in the present disclosure, but the zones 1, 2 can be out-door areas where the comfortable air flow is required without departing from the scope of the present disclosure.

The meeting room-booking system 100 includes a communication network 101 that connects an occupancy server 103, a facility control sever 105 and client terminals 109-A, 109-B, 109-C. The communication network 101 may be any suitable networks, such as a wireline network, a cellular network, a wireless local area network (WLAN), an optical network, etc. The communication network 101 may also be a combination of the suitable networks.

The communication network 101 communicates data between network elements in the meeting room-booking system 100. The data communicated over the communication network 101 includes meeting requests made by the users A, B, C through the client terminals 109-A, 109-B, 109-C. The data may include control commands that control operation of the energy-consuming devices of the facility 107 and access to the facility 107. The data may also include other suitable information without departing from the scope of the present disclosure.

The client terminal 109-A, 109-B, 109-C may be any suitable computing devices that can be used by the users A, B, C to make meeting requests to the occupancy server 103. For example, the client terminal 109-A, 109-B, 109-C can be a mobile phone, a desktop, a laptop, and a tablet or the like. The client terminals 109-A, 109-B, 109-C have a communication interface with the communication network 101 through which the meeting requests made by the users A, B, C are sent from the client terminals 109-A, 109-B, 109-C to the occupancy server 103.

Figure 12:
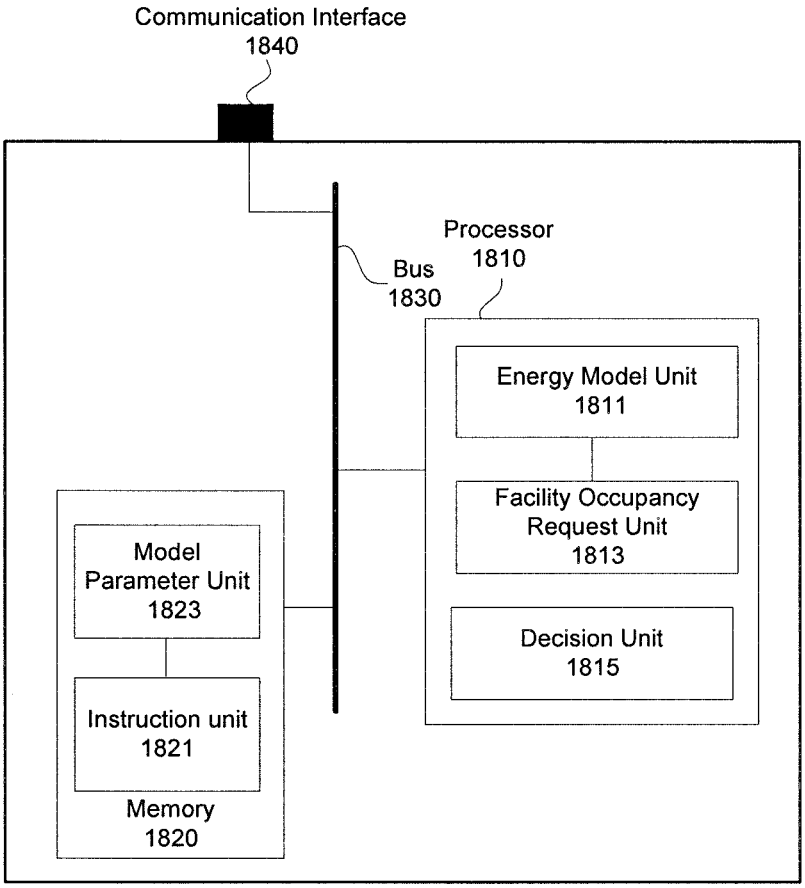
FIG. 12 illustrates an example schematic diagram of a computer system in accordance with the present disclosure.

The occupancy server 103 is a computer system that processes the meeting requests received from the client terminals 109-A, 109-B, 109-C. An example of such a computer system is illustrated in FIG. 12. Upon receipt of the meeting requests from the client terminals 109-A, 109-B, 109-C, the occupancy server 103 applies the meeting requests to an energy model representing the energy consumed by the plurality of devices of the facility 107. The energy model includes a first plurality of variables for operating the plurality of energy-consuming devices of the facility 107 and a second plurality of variables for scheduling the meetings to be held in the facility. As a result of the application of the meeting request to the energy model, the values of the first plurality of variables for operating the plurality of energy-consuming devices of the facility 107 and the values of the second plurality of variables for scheduling the meetings are automatically determined at the same time in an integrated way to optimise energy consumption of the facility 107.

In the present disclosure, the values of the first plurality of variables indicate the operation conditions of the energy-consuming devices of the facility 107, for example, the air flow rates and the air temperatures supplied by the energy-consuming devices at different time periods. The values of the second plurality of variables indicates availability of the zones 1, 2 of the facility 107, for example, which and when the zones 1, 2 are available for the meetings requested by the users A, B, C.

The values of the first plurality of variables and the values of the second plurality of variables are sent from the occupancy server 103 to the facility control server 105. The facility control server 105 controls operation of the energy-consuming devices of the facility 107 according to the values of the first plurality of variables, and availability of the zones 1, 2 according to the values of the second plurality of variables. On the other hand, availability information about zones 1, 2 are sent back to the client terminals 109-A, 109-B, 109-C, so the users A, B, C can access the right zone at the right time.

It should be noted that the occupancy server 103 and the facility control server 105 are illustrated as separated network elements in FIG. 1, but one of them may be integrated with the other. For example, the occupancy server 103 may be a physical or logical part of the facility server 105.

An Example Method for Controlling Operation of the Energy-Consuming Devices

Figure 2:
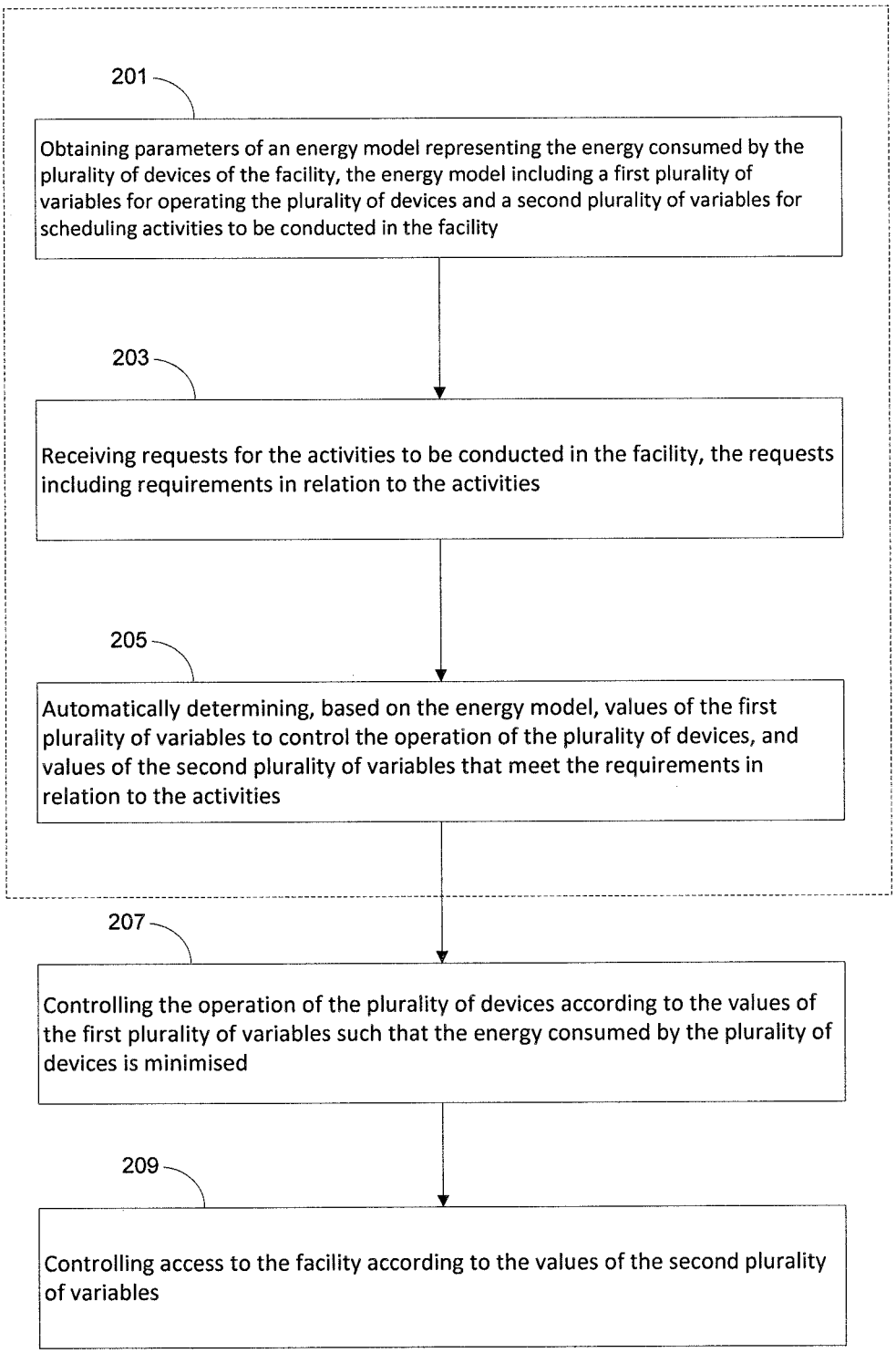
FIG. 2 illustrates an example method for controlling operation of energy-consuming devices of a facility in accordance with the present disclosure.

An example method 200 for controlling operation of the energy-consuming devices of the facility 107 is illustrated in FIG. 2. The method 200 is performed by the occupancy server 103 in the present disclosure for ease of description. As understood by a person skilled in the art, in other examples, the method 200 may be performed by the facility control sever 105 or any other suitable computing devices. Further, the order of the steps of the method 200, or other steps that are described in the present disclosure may not be limited to the order shown or described in the present disclosure, those steps may be executed in a different order where appropriate without departing from the scope of the present disclosure.

Obtaining Parameters of an Energy Model (201)

As shown in FIG. 2, the occupancy server 103 obtains 201 parameters of the energy model representing the energy consumed by the plurality of devices of the facility 107. An example of the energy model applied in the present disclosure is described with reference to FIGS. 3 to 5.

The parameters of the energy model includes a heat capacity of air for the one or more air conditioners of the facility 107, a ventilation coefficient of the one or more ventilation devices, and a predetermined temperature of air conditioned by the one or more air conditioners.

The parameters may also include:

a lower bound for an air flow rate supplied by the one or more air control units, an upper bound for the air flow rate supplied by the one or more air control units, for a location in the facility where one of the activities is to be conducted, a first lower bound for an air temperature supplied by the one or more air control units, for a location in the facility where none of the activities is to be conducted, a second lower bound for the air temperature supplied by the one or more air control units, for a location in the facility where one of the activities is to be conducted, a first upper bound for the air temperature supplied by the one or more air control units, and for a location in the facility where none of the activities is to be conducted, a second upper bound for the air temperature supplied by the one or more air control units.

These parameters may be stored in a storage device that the occupancy server 103 has access to, for example, an internal memory of the occupancy server 103, an external memory, a third-part database. The occupancy server 103 obtains these parameters by retrieving the parameters from the storage device. In other examples, the occupancy server 103 may request for these parameters with an energy model parameter database (not shown in FIG. 1). In response to the request, the energy model parameter database sends these parameters to the occupancy server 103. The occupancy server 103 then obtains these parameters by receiving these parameters from the energy model parameter database. The occupancy server 103 may obtain these parameters in other suitable ways without departing from the scope of the present disclosure.

As described above with reference to FIG. 1, the energy model includes the first plurality of variables for operating the plurality of devices and the second plurality of variables for scheduling activities to be conducted in the facility 107. The values of the variables of the energy model are output of the energy model and used to control the operation of the energy-consuming devices of the facility 107, particularly, the HVAC system 300, and access to the zones 1, 2 of the facility 107.

Figure 3:
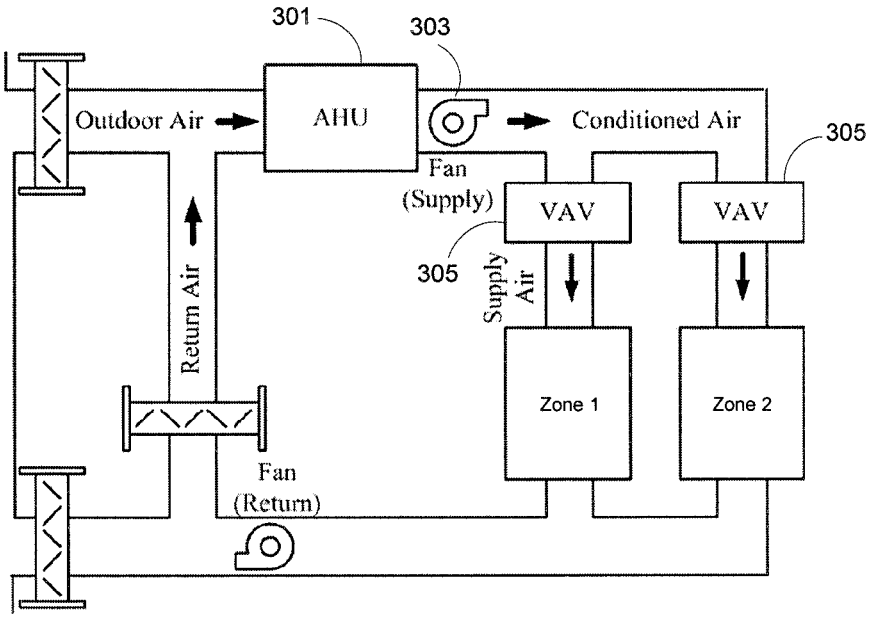
FIG. 3 illustrates a heating, ventilation and air-conditioning (HVAC) system in accordance with the present disclosure.

The HVAC system 300 as shown in FIG. 3 is a variable-air-volume (VAV) based HVAC system. Each of the zones 1, 2 or locations of the facility 107 can be an individual room or a group of rooms. To simplify notation, it is assumed in this example that each zone corresponds to a single room. In other examples, there may be more zones in the facility 107, and some of the zones may include multiple rooms without departing from the scope of the present disclosure.

As shown in FIG. 3, the plurality of energy-consuming devices of the facility 107 includes one or more air conditioners 301 (e.g., Air Handling Unit (AHU)), one or more ventilation devices 303 (e.g., supply fans), and one or more air control units 305 (e.g., Variable-Air-Volume (VAV) units) that are powered by electricity.

Let $K=\{1 \ldots n\}$ be a finite set of discrete time steps over an observation horizon. For simplicity, assuming that successive time steps are separated by a fixed duration $\Delta t \in \mathbb{R}^+$; that is, for $\forall k \in K$, $t_k \in \mathbb{R}^+$ and $t_k - t_{k-1} - \Delta t$. The objective is to minimise the total energy consumed over the observation horizon:

$$\text{minimise} \sum_{k \in K} e_k \tag{1}$$

where $e_k$ is the energy consumed at time step k:

$$e_k = p_k \times \Delta t \forall k \in K \tag{2}$$

The power $p_k$ is consumed by the three maim operations shown in FIG. 3: the air conditioning operation performed centrally by the air handling unit (AHU) 301 consumes $p_k^{Cond}$; the fan operation, also performed centrally by the supply fan 303, consumes $p_k^{Fan}$; and the reheating operation performed locally at each zone $l \in L$ by the zone's VAV units 305 consumes $p_{l,k}^{Heat}$ at each zone. Therefore, $$p_k = (p_k^{Cond} + p_k^{Fan} + p_{l,k}^{Heat}) \forall k \in K \tag{3}$$

Air Conditioning Operation.

The air handling unit (AHU) 301 admits a mixture of outside air at temperature $T_k^{OA}$ and return air, and conditions it to a predetermined air temperature $T^{CA}$ (usually 12.8° C.). The conditioned air is then distributed through the supply duct to the VAV units 305 at each zone 1, 2. The AHU consumption $p_k^{Cond}$ is the power consumed in cooling the total air flow required. Let $\alpha_{l,k}^{SA}$ denote the air flow rate required by location l at time step k and $C^{pa}$ the heat capacity of air at constant pressure (1.005 kJ/kg·K):

$$p_k^{Cond} = C^{pa}(T_k^{OA} - T^{CA}) \sum_{l \in L} \alpha_{l,k}^{SA} \ \forall k \in K \tag{4}$$

Fan Operation.

The supply fan 303, which may be driven by a variable frequency drive, maintains a constant static pressure in the supply duct. When the opening of the VAV dampers increases to pull in more air flow into the conditioned space (or decreases to pull less air flow), the fan speeds up (or slows down). The fan consumption is the power consumed by the supply fan 303 to push the total air flow required through the supply duct, which is proportional to the sum of the air flow rates $\alpha_{l,k}^{SA}$ required over all locations. Let β be the fan coefficient (0.65):

$$p_k^{Fan} = \beta \sum_{l \in L} \alpha_{l,k}^{SA} \ \forall k \in K \tag{5}$$

Reheating Operation.

As shown in FIG. 3, each zone l has a VAV unit 305 connected to the supply duct. The VAV unit 305 is equipped with continuously adjustable valves and reheat coils (not shown in FIG. 3). These adjustable valves and reheat coils enable regulating the air flow rate $\alpha_{l,k}^{SA}$ into the zone and modulating the supply air temperature $T_{l,k}^{SA}$ to maintain the zone temperature within given bounds, if necessary by reheating the supply air. The power $p_{l,k}^{Heat}$ consumed by the reheating process to heat the supply air from the conditioned temperature $T^{CA}$ to an appropriate location supply air temperature $T_{l,k}^{SA}$.

$$p_{l,k}^{Heat} = C^{pa}(T_{l,k}^{SA} - T^{CA}) \alpha_{l,k}^{SA} \forall l \in L, k \in K \tag{6}$$

Decision Variables.

As shown above, the key HVAC decision variables in the present disclosure are the supply air flow rate $\alpha_{l,k}^{SA}$ and temperature $T_{l,k}^{SA}$ at each location $l \in L$ and time step $k \in K$. Given occupancy information about the zones and bounds on supply air temperature, supply air flow rate, and room temperature during vacant and occupied periods, the values of these variables are determined to control the operation of the energy-consuming devices of the facility 107. A further decision variable $w_{l,k}$ is introduced to determine if and when the HVAC system 300 should be activated before the meetings, for example, before standard operating hours (e.g., 6:00 am to 6:00 pm), which may in turn influence the bounds. Meeting scheduling, or generally speaking, activity scheduling, that reflects zone or location occupancy is a parameter of the energy model. However, when the activity scheduling is integrated to the HVAC system 300 as described below, activity scheduling turns into variables.

Temperature and Air Flow Bounds.

The bounds on the actual location temperature, supply air temperature and supply air flow rate in each location l is represented as a function of the location occupancy and the time of the day. To do this, an auxiliary variable $T_{l,k}$ and a Boolean parameter $z_{l,k}$ are introduced. The auxiliary variable $T_{l,k}$ represents the actual temperature at location l Î L and time step k Î K, and the Boolean parameter $z_{l,k}$ is true if and only if a location l is occupied at time step k. When a location l is not occupied, its temperature can lie freely within a wider temperature range $[T^{uncon,lb}, T^{uncon,ub}]$. If the location l is occupied, the temperature at the location l is constrained to lie within a more restricted comfort range $[T^{uncon,lb}+C^{lb}, T^{uncon,ub}-C^{ub}]$, where $C^{lb}$ and $C^{ub}$ are appropriate constants. This constraint is expressed as follows:

$$T^{uncon,lb} + C^{lb} z_{l,k} \le T_{l,k} \le T^{uncon,lb} - C^{ub} z_{l,k} \tag{7}$$

Further, the supply air temperature and flow rate at each location l are constrained in a way that depends on the operating mode of the HVAC system 300 at the current time step k. The HVAC system 300 has two operating modes: active mode and standby mode. Let $K^s \subseteq K$ be the set of time steps that fall within the standard operating hours (for example, 6:00 am to 6:00 pm). During the standard operating hours ($k \in K^s$) the HVAC system 300 is always in active mode. The supply air temperature $T_{l,k}^{SA}$ at location l must fall within $[T^{CA}, T^{SA,ub}]$. The supply air flow rate $\alpha_{l,k}^{SA}$ must fall within $[\alpha_l^{SA,lb}, \alpha^{SA,ub}]$ where the upper bound is the air flow rate obtained when the dampers of VAV units 305 are fully open, and the lower bound is a constant (depending on the area size of the location and on the return air ratio) necessary to ensure that the minimal fresh outside air requirements are met. This yields the constraints:

$$T^{CA} \le T_{l,k}^{SA} \le T^{SA,ub} \forall l \in L, k \in K^s \tag{8}$$

$$\alpha_l^{SA,lb} \le \alpha_{l,k}^{SA} \le \alpha_l^{SA,ub} \forall l \in L, k \in K^s \tag{9}$$

Outside the standard operating hours ($k \in K \backslash K^s$), the HVAC system 300 is in standby mode and will only activate if this enables or lowers the cost of satisfying a future constraint. For instance, the HVAC system 300 may activate at night and benefit from the low outside night temperature to more economically cool the supply air to meet the temperature bounds in (7) for an early morning meeting. This is different from conventional operations where HVAC systems are always off outside the standard operating hours. Experiments shows that the standby mode enables model-predictive approaches to occupancy-based control to meet constraints and save energy. Whether or not HVAC activation is required at location l is represented by the Boolean decision variable $w_{l,k}$. The presence of these Boolean variables, which represent activation status of the HVAC system 300 outside the standard operating hours, makes the energy model a mixed-integer model. When $w_{l,k}$ is true, the supply air flow rate and temperature are constrained to lie within $[T^{CA}, T^{SA,ub}]$ and $[\alpha_l^{SA,lb}, \alpha^{SA,ub}]$, respectively. When $w_{l,k}$ is false, $\alpha_{l,k}^{SA}$ is set to zero and the value of $T_{l,k}^{SA}$ is irrelevant (and for simplicity may be zero). This is captured by the following constraints:

$$T^{CA} w_{l,k} \le T_{l,k}^{SA} \le T^{SA,ub} w_{l,k} \ \forall k \in K \tag{10}$$

$$\alpha_l^{SA,lb} w_{l,k} \le \alpha_{l,k}^{SA} \le \alpha_l^{SA,ub} w_{l,k} \ \forall k \in K \tag{11}$$

Facility Thermal Dynamics Model.

Having defined the space of decision variables as the supply air flow rate $\alpha_{l,k}^{SA}$, the supply air temperature $T_{l,k}^{SA}$ and the HVAC activation requirement $w_{l,k}$ at each location and time step, the impact of these decision variables on the facility thermal exchanges is modelled below.

To model the thermal dynamics of the facility 107, a computationally efficient lumped RC-network mode is adopted, as described in Gouda, M.; Danaher, S.; and Underwood, C. 2000. *Low-order model for the simulation of a building and its heating system*. Building Services Engineering Research and Technology 21(3):199-208. The RC-network model incorporates the thermal resistance and capacitance of each zone and between adjacent zones, as well as the solar gain and the internal heat gain in each zone, particularly, the heat gain resulting from attendees at the meetings. For the sake of simplicity, humidity and infiltration is not considered in this example. However, humidity and infiltration may be considered in other examples without departing from the scope of the present disclosure.

Figure 4:
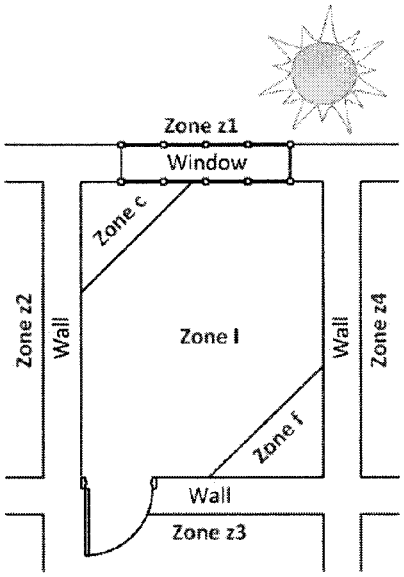
FIG. 4 illustrate a zone structure of a facility in accordance with the present disclosure.
Figure 5:
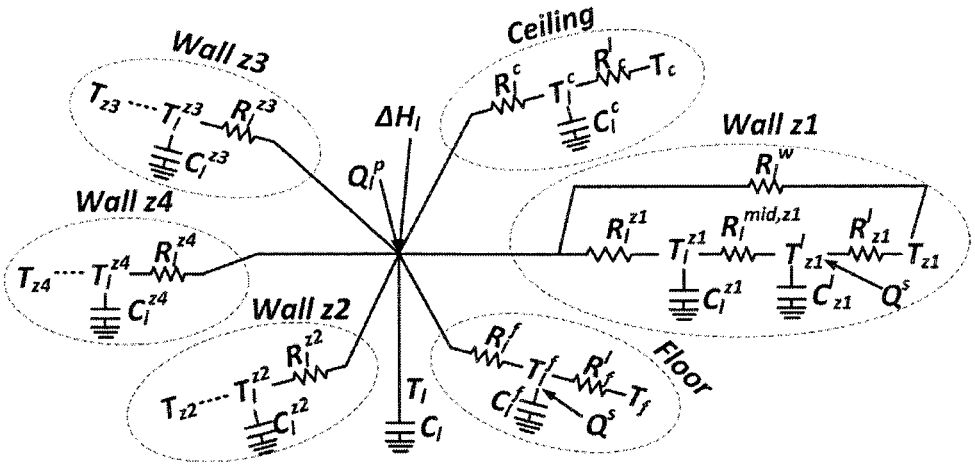
FIG. 5 illustrates a lumped RC-network for the zone structure shown in FIG. 4.

The principles behind the facility thermal dynamics model are illustrated in FIGS. 4 and 5. FIG. 4 shows the zone structure 400 adopted in this example. It should be noted that the zone structure may be different in other examples without departing from the scope of the present disclosure.

In the example shown in FIGS. 4 and 5, zone l is separated by a wall and a window from zone z1 and by a wall from zones z2, z3, and z4, which represent either indoor or outdoor zones. Zone l is also separated by the ceiling and floor from zones c and f which are above and below zone l, respectively. Zone l has a capacitance $C_l$ that models the heat capacity of the air in the zone. Zone l also has a solar gain $Q_{l,k}^{s}$ and heat gain $Q_{l,k}^{p}$ at time step k. Moreover, the inner and outer walls separating zone l from zone $z \in Z = \{z1, z2, z3, z4, f, c\}$ have capacitances $C_l^z$ and $C_z^l$, resistances $R_l^z$ and $R_z^l$, and temperatures $T_{l,k}^{z}$ and $T_{z,k}^{l}$ at time step k. The window has a resistance $R_l^w$. The internal node between the inner and outer walls separating zone l from $z \in \{z1, z2, z3, z4\}$ has a constant resistance $R_l^{mid,z}$.

Capacitances, resistances, solar gain, and heat gain are parameters of the energy model whilst temperatures are auxiliary variables. The interaction between zones is modelled using a lumped RC-network. Specifically, 3R2C is used for walls separating two zones, 2R1C for the ceiling and floor and 1R for windows. The lumped RC-network 500 for FIG. 4 is given in FIG. 5.

The lumped RC-network 500 may be represented by a set of coupled difference equations, summarised as below.

The first difference equation defines the temperature $T_{l,k}$ in zone l at time step k as a function of the location, inner walls, ceiling, floor and outdoor temperatures at the previous time step, of the heat gain $Q_{l,k-1}^{p}$ at the previous time step and of the enthalpy $\Delta H_{l,k-1}$ of the location due to the supply air:

$$\frac{C_l}{\Delta t}(T_{l,k} - T_{l,k-1}) = -\left[\sum_{z \in Z} \frac{1}{R_l^z} + \frac{1}{R_l^w}\right] T_{l,k-1} + \sum_{z \in Z} + \frac{T_{l,k-1}^{z}}{R_l^z} + \frac{T_{k-1}^{OA}}{R_l^w} + Q_{l,k-1}^{p} + \Delta H_{l,k-1} \tag{12}$$

The heat gain $Q_{l,k}^{p}$ is simply the heat gain $q^p$ generated per person (75W) times the number of occupants $pp_{l,k}$:

$$Q_{l,k}^{p} = q^p \times pp_{l,k} \tag{13}$$

The enthalpy is defined as follows:

$$\Delta H_{l,k} = C^{pa} \alpha_{l,k}^{SA} (T_{l,k}^{SA} - T_{l,k}) \tag{14}$$

The remaining difference equations define the temperatures $T_{l,k}^{z}$ and $T_{z,k}^{l}$ of the inner and outer walls at time step k as a function of each other and of the location temperature $T_{l,k-1}$ at the previous time step. Taking z=z1 in the example of FIG. 4:

$$\frac{C_{z1}^{l}}{\Delta t}(T_{z1,k}^{l} - T_{z1,k-1}^{l}) = -\left[\frac{1}{R_{z1}^{l}} + \frac{1}{R_l^{mid,z1}}\right] T_{z1,k-1}^{l} + \frac{T_{z1,k1}}{R_{z1}^{l}} + \frac{T_{l,k-1}^{z1}}{R_l^{mid,z1}} \tag{15}$$

The definition of $T_{l,k}^{z}1$ is symmetrical except for the absence of solar gain $Q_{k-1}^{s}$. The equations for the other walls, and the ceiling and floor can be established in a similar way, which are not given in the present disclosure.

MILP Relaxation.

The energy model as described above is a mixed-integer non-linear (MINLP) model. This is because of the bilinear terms $\alpha_{l,k}^{SA} T_{l,k}^{SA}$ and $\alpha_{l,k}^{SA} T_{l,k}$ in equations (6) and (14). From a computational standpoint, it is better to relax these equations so as to obtain a mixed-integer linear (MILP) model for which effective solvers exist that are guaranteed to return a lower bound on the globally optimal MINLP objective. To obtain a suitable MILP, the linear programming relaxation of bilinear terms is used in the present disclosure, as described in McCormick, G. P. 1976. *Computability of global solutions to factorable nonconvex programs: Part I—convex underestimating problems*. Mathematical programming 10(1):147-175. This relaxation introduces a new variable v for the bilinear term xy together with four inequalities that define its convex envelope using the bounds $[\underline{x},\overline{x}]$ and $[\underline{y},\overline{y}]$ on each of the two variables involved:

$$v \geq \underline{x}y + \underline{y}x - \underline{x}\underline{y}$$

$$v \geq \overline{x}y + \overline{y}x - \overline{x}\overline{y}$$

$$v \leq \underline{x}y + \overline{y}x - \underline{x}\overline{y}$$

$$v \leq \overline{x}y + \underline{y}x - \overline{x}\underline{y}$$

Hence, our MILP model is derived from the MINLP model by replacing the bilinear terms $\alpha_{l,k}^{SA} T_{l,k}^{SA}$ and $\alpha_{l,k}^{SA} T_{l,k}$ in equations (6) and (14) with new variables and adding the corresponding convex envelope definitions. The relevant bounds are:

$$a_{l,k}^{SA} \in [\underline{a}_{l,k}^{SA}, \overline{a}_{l,k}^{SA}] = \begin{cases} [a^{SA,lb}, a^{SA,ub}] & \text{for } k \in K^s \\ [0, a^{SA,ub}] & \text{for } k \in K \setminus K^s \end{cases}$$

$$T_{l,k}^{SA} \in [\underline{T}_{l,k}^{SA}, \overline{T}_{l,k}^{SA}] = \begin{cases} [T^{CA}, T^{SA,ub}] & \text{for } k \in K^s \\ [0, T^{SA,ub}] & \text{for } k \in K \setminus K^s \end{cases}$$

$$T_{l,k} \in [\underline{T}_{l,k}, \overline{T}_{l,k}] = [T^{unocc,lb}, T^{unocc,ub}] \text{ for } k \in K$$

Using the above MILP model, given the activity scheduling $pp_{l,k}$ and $z_{l,k}$, and the external temperature $T_k^{OA}$, the supply air flow rate $\alpha_{l,k}^{SA}$ and temperature $T_{l,k}^{SA}$ may be determined Further, if the standby mode is enabled, the HVAC system 300 may be activated outside the standard operating hours, as indicated by $\omega_{l,k}$. As a result, the total energy consumption $$\sum_{k \in K} e_k$$

is optimised. The advantage of this model lies in its integration of computational efficiency, its adequacy as a component of activity scheduling and other more complex models, and its optional ability to activate out of the standby mode when this improves energy consumption.

As described above, the activity scheduling over time is taken as parameters. In the description below, the activity scheduling are decision variables in the energy model.

Let $M \subseteq \mathbb{N}$ be a set of meetings to be scheduled to take place at the locations in L during the observation time horizon K. Each meeting $m \in M$ is characterised by one or more the following requirements:

- a duration of the meeting $\tau_m \in \mathbb{N}$ (number of time steps),
- one or more starting time windows, represented by a set of allowable time steps $K_m \subseteq K$ at which the meeting can start,
- a set of allowable locations $L_m \subseteq M$ where the meeting can take place,
- a set of attendees $P_m \subseteq A$, for some appropriate set of attendees A, and
- the number of the attendees, and identifications of the attendees.

In addition, let $N \subseteq 2^M$ be the set of meeting sets which have at least one attendee in common, that is $N=\{M_i \subseteq M \mid \forall m,m' \in M_i,\ P_m \cap P_{m'} \neq \emptyset\}$. In practice, only all pairs of incompatible meetings are needed. Note that the sets $K_m$ and $L_m$ can be used to represent a variety of situations, such as room capacity requirements and availability of special equipment such as video conferencing, as well as time deadlines for the meeting occurrence and attendee availability constraints.

The main meeting scheduling variable is the Boolean decision variable $x_{m,l,k}$ which is true if and only if a meeting $m \in M$ is scheduled to take place at location $l \in L_m$ starting at time step $k \in K_m$. The scheduling part of the energy model interacts with the HVAC system part of the model via the auxiliary variables $z_{l,k}$. $z_{l,k}$ is true if and only if location l is occupied at time step k, and $pp_{l,k} \in \mathbb{N}$, which represents the number of attendees at location l at time step k, as defined with reference to equations (7) and (13), respectively. It should be noted that $z_{l,k}$ are variables rather than parameters.

The scheduling of the meetings may be subject to constraints. Some examples of MILP scheduling constraints are shown as follows.

The first example constraint ensures that all meetings are scheduled to occur exactly once within the range of allowable locations and start times:

$$\sum_{l \in L_m, k \in K_m} x_{m,l,k} = 1 \ \forall m \in M \tag{16}$$

The second example constraint ensures that if a location is occupied by a meeting then it is exclusively occupied by this meeting during its entire duration:

$$\sum_{\substack{m \in M, k' \in K_m \\ \text{such that} \\ l \in L_m \text{ and } k-\tau_m+1 \le k' \le k}} x_{m,l,k} \le z_{l,k} \ \forall l \in L, k \in K \tag{17}$$

As a result, no two meetings can occupy the same location at the same time step. Observe that (17) also determines the occupancy variable $z_{l,k}$.

The third example constraint establishes the number of occupants $pp_{l,k}$ of each location l at each time step k:

$$\sum_{\substack{m \in M, k' \in K_m \\ \text{such that} \\ l \in L_m \text{ and } k-\tau_m+1 \le k' \le k}} x_{m,l,k'} \times |P_m| = pp_{l,k} \ \forall l \in L, k \in K \tag{18}$$

This is used in equation (13) to establish the internal heat gain arising from the attendees.

The fourth example constraint ensures that meetings with an intersecting attendee set cannot overlap in time:

$$\sum_{\substack{m \in v, l \in L_m, k' \in K_m \\ \text{such that} \\ k-\tau_m+1 \le k' \le k}} x_{m,l,k'} \le 1 \ \forall k \in K, v \in N \tag{19}$$

It can be seen from the above that by adding equations (16) to (19) to the HVAC system 300 given by equations (1)-(15) (optionally, with equations (6) and (14) linearised), the energy model in the present disclosure optimises the total energy consumed not only over the HVAC decision variables $\alpha_{l,k}^{SA}$, $T_{l,k}^{SA}$ and $w_{l,k}$ but also over the scheduling decision variables $x_{m,l,k}$.

Receiving Requests for the Activities be Conducted in the Facility (203)

Figure 6:
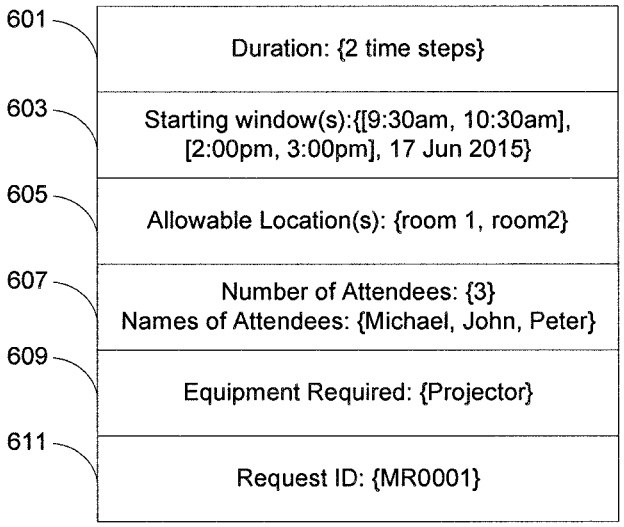
FIG. 6 illustrates an example meeting request in accordance with the present disclosure.

As described above, users A, B, C make meeting requests to the occupancy server 103 via the respective client terminals 109-A, 109-B, 109-C. An example meeting request 600 made by the user A is illustrated in FIG. 6. Although the request 600 is described as a request for a meeting in this example, the request 600 can be used to request for any suitable activities to be conducted in the facility 107, for example, teaching, party, examination, etc., without departing from the scope of the present disclosure.

The meeting request 600 in this example is a message having multiple fields that is suitable for transmission over the communication network 101. For example, the meeting request 600 can be an Internet Protocol (IP) packet message.

The meeting request 600 indicates that the duration of the meeting is two time steps, as shown in the field 601. If one time step represents half hour in the present disclosure, the duration of the meeting indicated by the meeting request 600 is one hour. The meeting can start from 9:30 am to 10:30 am, 17 Jun. 2015 or from 2:00 pm to 3:00 pm, 17 Jun. 2015, as shown in the field 603. The meeting may be held in room 1 or room 2 of the facility 107, as shown in the field 605. The meeting request 600 also shows the number of the attendees is 3, and the names of the attendees are Michael, John and Peter, as shown in the field 607. The meeting request 600 further indicates that room in which the meeting is to be held must have a projector, as shown in the field 609. The meeting request 600 also includes a request ID to identify the meeting request 600, as shown in the field 611.

In this example, the meeting request 600 is made by the user A and sent from the client terminal 109-A to the occupancy server 103 over the communication network 101. In other examples, the meeting request 600 may be sent to a separate database (not shown in FIG. 1) from the client terminal 109-A, and the occupancy server 109 retrieves the meeting request 600 from the third-party database.

Automatically Determining Values of the Variables (205)

Upon receipt of the meeting requests from the client terminals 109-A, 109-B, 109-C, the occupancy server 103 applies the meeting requests to the energy model as described above to automatically determine the values of the variables of the energy model at the same time. Particularly, the occupancy server 103 determines the values of the first plurality of variables in this case being the supply air flow rate $\alpha_{l,k}^{SA}$ and temperature $T_{l,k}^{SA}$, to control the operation of the plurality of devices of the facility 107, and the values of the second plurality of variables $x_{m,l,k}$ for scheduling the meetings in an integrated way to optimise energy consumption of the facility 107. An example method of solving the MILP model as described above is described in I. Gurobi Optimization. *Gurobi optimizer reference manual,* 2014.

Unlike the conventional methods, in which either the operation of the energy-consuming devices or the meeting schedule are known parameters and the other one is optimised, the energy model described above takes both the operation of the energy-consuming devices and the meeting schedule as variables, and optimises the energy consumption over both the operation of the energy-consuming devices and the meeting schedule. As a result, the operation of the energy-consuming devices and the meeting schedule are determined at the same time and the minimised energy consumption can always be achieved.

Controlling the Operation of the Energy-Consuming Devices (207)

Once the value of the first plurality of variables, particularly, the supply air flow rate $\alpha_{l,k}^{SA}$ and temperature $T_{l,k}^{SA}$, are determined by the occupancy server 103, these values are sent from the occupancy server 103 to the facility control server 105 to control the operation of the energy-consuming devices. As a result, the HVAC system 300 operates to supply air to zone l at the supply air flow rate $\alpha_{l,k}^{SA}$ and temperature $T_{l,k}^{SA}$ at time step k to minimise the energy consumption of the facility 107. As described above, if the standby mode is enabled, the energy-consuming devices of the facility 107 may be activated outside the standard operating hours, for example, at night, to minimise the energy consumed by the energy-consuming devices.

Controlling Access to the Facility (209)

Once the value of the second plurality of variables, particularly, meeting schedule variables $x_{m,l,k}$, are determined by the occupancy server 103, these values are sent from the occupancy server 103 to the facility control server 105 to control access to the meeting rooms of the facility 107. For example, the values of the meeting scheduling variables may be programmed by the control sever 103 to electronic locks (not shown) of the meeting rooms. As a result, the meeting rooms are only available to the attendees at the times indicated by the true values of the Boolean meeting schedule variables $x_{m,l,k}$.

A Numerical Example

Figure 7A:
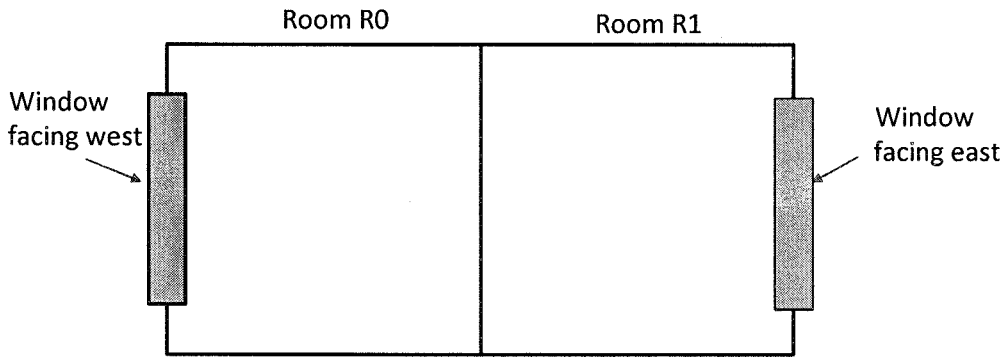
FIG. 7(*a*) to (*f*) illustrate a numerical example of a method for controlling operation of energy-consuming devices of the facility in accordance with the present disclosure.
Figure 7B:
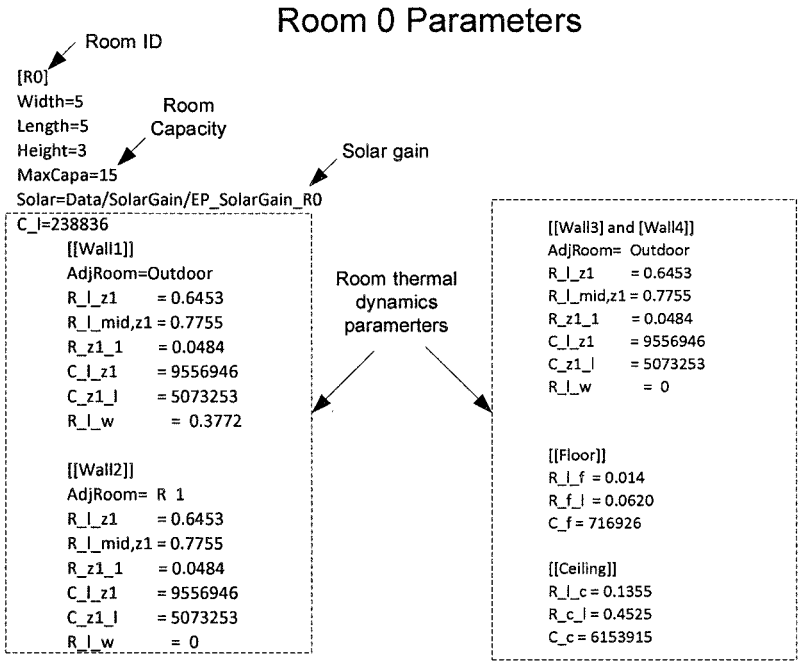
Figure 7C:
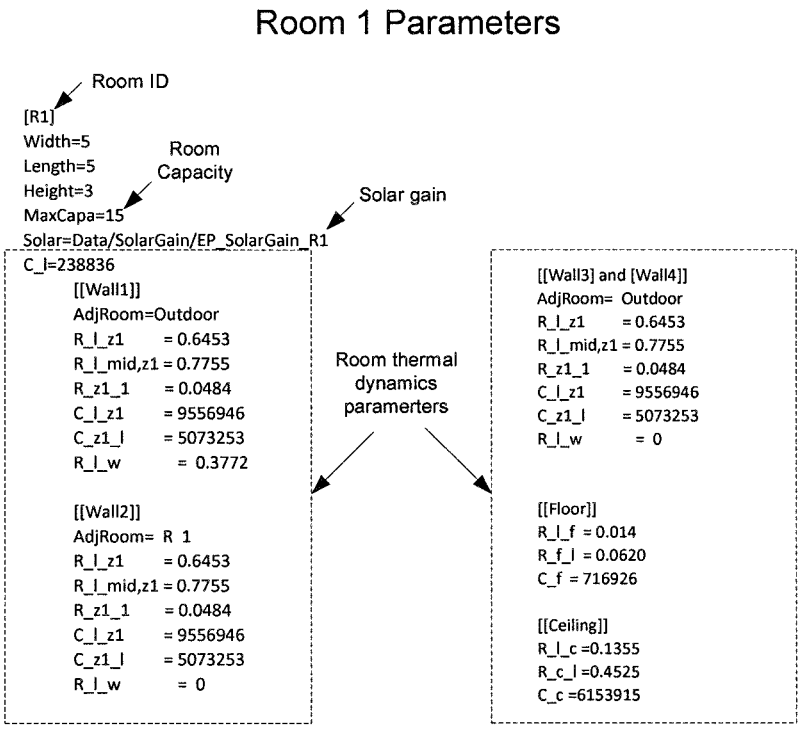

FIG. 7(*a*) to (*f*) illustrate a numerical example of the method described above.

FIG. 7(*a*) illustrates a facility 700 with two meeting rooms R0, R1 separated by a wall. The meeting rooms R1, R2 has a west-facing window and an east-facing window, respectively.

FIGS. 7(*b*) and 7(*c*) illustrate the parameters 800 of the meeting rooms R0, R1. These parameters include Room ID, room capacity, solar gain, room thermal dynamics parameters (for example, thermal resistance, thermal capacitance). It should be noted the parameters 800 shown in FIGS. 7(*b*) and (*c*) are example parameters of the meeting rooms, and other parameters may be used.

FIG. 7(*d*) illustrates the parameters 900 of the HAVC system supplying air flow to the facility 700. Using the parameters shown in FIG. 7(*b*) to (*d*), the energy model described above can be constructed by the occupancy server 103. It should be noted the parameters 900 shown in FIG. 7(*d*) are example parameters of the HVAC system, and other parameters may be used.

FIG. 7(*e*) illustrates meeting requests 1000 that includes attendee IDs, durations, and starting time windows. The meeting request M1, M2 are transmitted in IP packet messages to the occupancy server 103.

FIG. 7(*f*) illustrates the values 1100 of the variables of the energy model as a result of applying the meeting request to the energy model.

As shown in FIG. 7(*f*), rooms 0, 1 are scheduled to be used for meeting requests M1, M2, starting from 9:00 am 1 Jul. 2011 with a duration of 2 hours, as indicated by a meeting schedule field 1101.

On the other hand, the operation of the HVAC system is controlled in a way as indicated by a HVAC operation field 1103. Particularly, the supply air flow rates and supply air temperatures of the VAV units of the HVAC system are determined according to the energy model. This way, the energy consumption of the facility 700 is minimised during the day. The energy consumption at each time step is shown in an energy consumption field 1105.

Performance Improvement

Our experiments aim at explaining the usefulness of the standby mode and at demonstrating that the energy model described in the present disclosure leads to significant consumption reduction (50% to 70% in our experiments) when compared to occupancy-based HVAC control using arbitrary schedules or energy-aware schedules generated by heuristic methods. Experiments are conducted over 5 summer days with a row of 4 co-located zones, each consisting of a single 60 $m^2$ room with a capacity of 30 people. The zones differ by a high or low value for their thermal resistance and capacitance. The two end zones have three outside walls and the middle two zones have two. The duration between successive time steps is Dt=30 min, giving more than enough time for thermal effects to occur. Shorter durations did not significantly affect the results. The MILP models are solved using the method described in Gurobi Optimization, I. 2014. *Gurobi optimizer reference manual*, http://www.gurobi.com. All experiments were conducted on a cluster consisting of 2×AMD 6-Core Opteron 4184, 2.8 GHz with 64 GB of memory.

Usefulness of Standby Mode.

We start by illustrating the usefulness of the standby mode. In conventional operations, the HVAC system are usually switched on a few hours prior to start of the standard operating hours (before 6:00 am) and are turned off in the evening (after 6:00 pm) and at night. Model predictive control strategies are capable of pre-cooling a zone, but only when the HVAC system is switched on. The standby mode in the present disclosure enables the HVAC system to activate outside the standard operating hours to provide additional pre-cooling when this is beneficial. Therefore, in the standby mode, the HVAC system starts to operate prior to the earliest possible start time of the all the activities to be held in a day. Because the energy consumption by the HVAC system is highly dependent on the temperature gap between the outdoor temperature and the conditioned air temperature, pre-cooling at night, when the outdoor air temperature is cooler, can reduce energy consumption. The following experiment shows that such pre-cooling can be beneficial not only for early morning meetings, but also, more surprisingly, for late afternoon meetings.

Figures 8, 9:
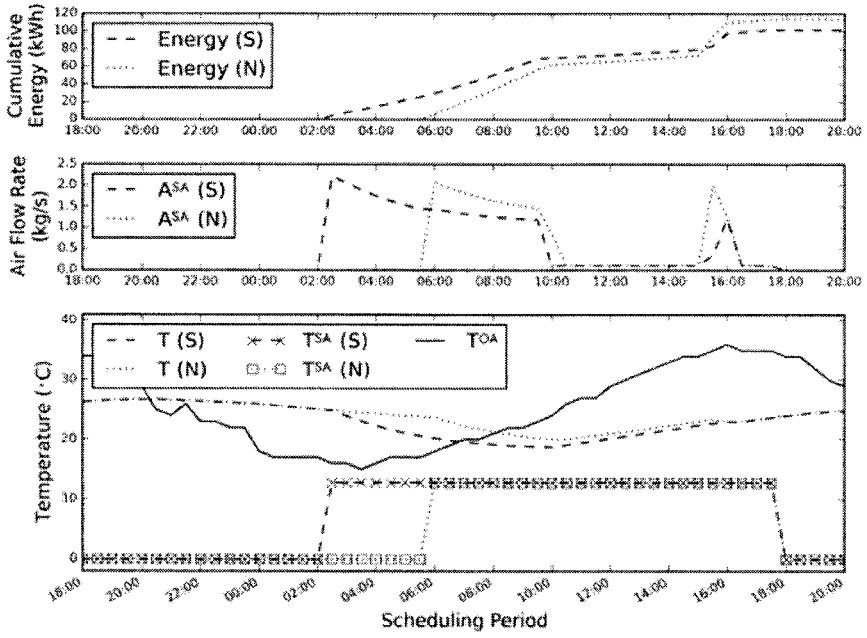
FIG. 8 illustrates a comparison between operations of the HVAC system with a standby mode and without the standby mode.
FIG. 9 illustrates an energy consumption comparison between HVAC system control strategies.

FIG. 8 illustrates a comparison between the operations of the HVAC system controlled by the energy model described above with standby mode (S) and without standby mode (N).

For this experiment, a single meeting is scheduled to occur between 16:00-17:00 in a given zone on a given day. Observe that when the HVAC system is running with the standby mode enabled, it activates as early as 02:30 and pushes between 2.2 and 1.2 kg/s of supply air at 12.8° C. to bring down the zone temperature to approximately 19° C. by 09:00. Between 02:30 and 06:00, the outdoor temperature is between 15 and 17° C., which is about 2-4° C. higher than the 12.8° C. conditioned air temperature. Without the standby mode, supply air is pushed into the room at a higher average rate between 2.0 and 1.5 kg/s right after the HVAC system is turned on at 06:00, which, as the outdoor temperature is higher at that time (18-22° C.), requires a higher rate of energy consumption. During the day, the zone temperature increases slightly due to the daytime thermal gain, and at 15:00, one hour before the meeting starts, the room is pre-cooled again. The standby-mode enabled HVAC system now only requires cooling about half the amount of supply air, which brings significant energy savings since the outside temperature is around 36° C. Altogether, the standby mode reduces consumption by 11.9% (12 kWh) in this example.

As shown above, a standby-mode-enabled HVAC system can be effective in areas with high diurnal temperature variation. In addition to decreasing energy consumption, the standby mode can provide pre-cooling at off-peak electricity cost. For organisations that are charged by electricity suppliers according to their peak consumption, another benefit of the standby mode is that it can help smooth the peak that is regularly observed at the start of the operating hours.

Joint Model Vs Simpler Models.

Whilst the standby mode is beneficial, the much larger gains in the energy model described above stem from taking both the operation of the HVAC system and the meeting scheduling as variables.

We now compare the energy model with simpler approaches representative of the existing literature on occupancy-based HVAC control and energy-aware meeting scheduling, and observe a 50%-70% energy consumption improvement. Specifically, we consider a set of timetabling problems derived from Melbourne University. 2002. PATAT 2002 Dataset, http://www.or.ms.unimelb.edu.au/timetabling/, and compare the optimal (O) solutions produced by the energy model described in the present disclosure with those produced by giving arbitrary (A) schedules and heuristic (H) energy-aware schedules as input parameters to the HVAC system 300. Scheduling meetings back to back in as few rooms as possible is conventionally considered to be a suitable heuristic that takes advantage of thermal inertia to reduce energy consumption, as described in Kwak, J.-y.; Varakantham, P.; Maheswaran, R.; Chang, Y.-H.; Tambe, M.; Becerik-Gerber, B.; and Wood, W. 2013. Tesla: *An energy-saving agent that leverages schedule flexibility*. In Proc. International Conference on Autonomous Agents and Multi-agent Systems (AAMAS), 965-972, Majumdar, A.; Albonesi, D. H.; and Bose, P. 2012. *Energy-aware meeting scheduling algorithms for smart buildings*. In Proc. ACM Workshop on Embedded Sensing Systems for Energy-Efficiency in Buildings (BuildSys), 161-168. ACM, and Pan, D.; Yuan, Y.; Wang, D.; Xu, X.; Peng, Y.; Peng, X.; and Wan, P.-J. 2012. *Thermal inertia: Towards an energy conservation room management system*. In Proc. IEEE International Conference on Computer Communications (IN-FOCOM), 2606-2610. In line with this, the heuristic we compare to minimise the number of rooms used and the time gap between meetings in these rooms, subject to the scheduling constraint equations (16)-(19).

In all three cases (A,H,O), we run the energy model with standby mode (S) and without it (N), resulting in six different methods labelled AN, AS, HN, HS, ON, OS, where for example, HS denotes HVAC system with standby mode using heuristic schedules.

To examine problems with different degree of constrainedness, we extracted 70 problem instances from the PATAT dataset, consisting of 40 instances of 10 meetings each, 20 instances of 20 meetings each, and 10 instances of 50 meetings each. All meetings have up to 30 attendees, a 1.5-hour duration and an allowable time range of one or two random days (09:00-17:00) within the 5 days of the experiment.

The AN/AS results are obtained by selecting, for each in-stance, an arbitrary schedule consistent with the scheduling constraint equations (16)-(19) and using it as an input parameter to the occupancy-based HVAC system 300. Similarly, the HN/HS results are obtained by selecting the schedule optimising the heuristic among those consistent with the scheduling constraints, and using it as an input parameter to the HVAC system 300. The ON/OS results are obtained by solving the energy model for each instance.

FIG. 9 shows, for each of the 6 approaches, the average energy consumption per room over the 70 instances, and the percentage excess consumption taking OS as the baseline. The results show a clear improvement as we move from arbitrary schedules (AN/AS), that are currently the norm with room booking systems, to energy aware schedules (HN/HS), and a much greater improvement when these schedules take into account the capabilities of occupancy-based HVAC control (ON/OS) based on the energy model described in the present disclosure. The interactions between the various scheduling constraints, the thermal dynamics of the building and the HVAC system 300 are so complex that heuristic methods can only achieve a fraction of the performance of the global optimisation methods enabled by the MILP model in the present disclosure. As expected, the gain conferred by the standby mode decreases as we move to schedules that make better time and location decisions. Similarly, it is observed that for more constrained problems (e.g. with 50 meetings), the standby mode is more effective, because there is a greater likelihood that meetings need to be scheduled in rooms that require higher cooling load which the standby mode can mitigate by pre-cooling.

Large Neighbourhood Search (LNS).

MILP as described above enables us to manage the tightly constrained interactions between meeting scheduling and energy consumption. However, it is not efficient enough to solve a large amount of problem instances in reasonable time. To scale to problem sizes that, for example, universities may face when scheduling exams, a hybrid solution is developed that embeds the MILP model into a large neighbourhood search (LNS), as described in Shaw, P. 1998. *Using constraint programming and local search methods to solve vehicle routing problems*. In Proc. International Conference on Principles and Practice of Constraint Programming (CP), 417-431.

LNS is a local search metaheuristic, which iteratively improves an initial solution by alternating between a destroy step and a repair step. The main idea behind LNS is that a large neighbourhood allows the heuristic to easily navigate through the solution space and escape local minima even when the problem is highly-constrained. One important decision when implementing the destroy step is to determine the amount of destruction. If too little is destroyed the effect of a large neighbourhood is lost and if too much is destroyed then the approach turns into repeated re-optimization.

Another important decision is whether the repair step should be optimal or not. An optimal repair will be slower than a heuristic, but may potentially lead to high quality solutions in a few iterations. As a result, parameter tuning is helpful in achieving good performance overall.

In the destroy step of the present disclosure, all meetings in two, three, or four randomly selected zones are removed. This forms a sub-problem that the repair step can effectively solve using MILP. Further, the MILP runtime is limited to avoid excessive search during repair. That means the sub-problem may not be necessarily solved optimality, but given that MILP solvers are anytime algorithms, solution quality is improved in many of the LNS iterations. The sequential model-based algorithm configuration (SMAC) methodology is used in the present disclosure, as described in Hutter, F.; Hoos, H. H.; and Leyton-Brown, K. 2011. *Sequential model-based optimization for general algorithm configuration*. In Proc. International Conference on Learning and Intelligent Optimization (LION), 507-523, on an independent set of problems to optimise the parameters of the probability of the number of rooms to destroy and the MILP run time. The LNS approach is detailed below.

Initial Solution.

The LNS approach starts with an initial feasible solution, which is generated using a greedy heuristic. First, this heuristic finds a feasible meeting schedule by minimizing the number of rooms. Second, it determines the HVAC system control settings of supply air temperature and supply air flow rate to minimise energy consumption given a fixed schedule. This two-stage process makes sure that there is always an initial solution found in reasonable time.

Destroy and Repair.

The LNS approach considers a neighbourhood that contains a subset of the rooms or zones. The schedule in two to four randomly selected rooms is destroyed. This forms a sub-problem that can be solved effectively using mixed integer programming (MIP). When destroying meetings in more than four zones, MIP performance degrades very quickly and even solving the linear programming relaxation can become quite time consuming. The repair consists of solving an energy aware meeting scheduling problem that is much smaller than the original problem. Further, MIP runtime is limited to avoid excessive search during a repair step, and to avoid any convergence issues of the MIP problem. Setting a limit on runtime means that the sub-problem is not necessarily solved optimality, but given that MIP solvers are anytime algorithms, solution quality is improved in many of the LNS iterations. If an improved solution is found, then the new schedule and operation control settings are accepted. Otherwise, the solution that was destroyed is kept. Given that the LNS approach starts with a feasible solution and does not accept infeasible solutions, the solution remains feasible throughout the execution of the LNS approach.

It should be noted that the destroy step in the LNS approach may be performed in different ways, for example: destroying all meetings in randomly selected time steps, a combination of destroying all meetings in randomly selected rooms and time steps, and simply destroying a set of randomly selected meetings. However, none of these ways performs as well as destroying all meetings in a number of randomly selected rooms. In the present disclosure, destroying the selected rooms means that meetings can be rescheduled at any time during the day. This allows the model to optimize supply air flow rate and supply air temperature over all the time steps. Destroying selected time steps means that meetings may switch rooms, but may need to be scheduled to the same time step due to time window restrictions. This limits the optimization of supply air flow rate and supply air temperature due to the HVAC system control constraints on neighbouring time steps.

LNS Parameter Tuning.

The parameters that govern the behaviours of the LNS heuristic are parameters determining the number of rooms (for example, 2, 3, or 4) to destroy and the MIP runtime limit for the repair step. The probabilities on the number of rooms to destroy are defined as a 3-tuple with values ranging between [0,1] and the MIP runtime limit is a parameter with values ranging between 1 and 10 seconds.

While it is possible to reason about certain parameters and their impact on overall performance, there are numerous values that these parameters can take on. Even though only 4 parameters are considered, it is impractical to try all possible configurations because of their continuous domains. In fact, even with discretised domains with reasonable level of granularity it remains impractical to try out all configurations. As a result, the automated algorithm-configuration method SMAC is used to optimize these parameters.

SMAC is be used to train parameters in order to minimise solution runtime, or to optimize solution quality. In the present disclosure, the problem instances are generated with different degrees of constrainedness and the parameters trained by SMAC to achieve the average best quality for all input scenarios.

Given a list of training instances and corresponding feature vectors, SMAC learns a joint model that predicts the solution quality for combinations of parameter configurations and instance features. These information are useful in selecting promising configurations in large configuration spaces. For each training instance up to 17 features are computed, including: (1) number of constraints, (2) number of variables, (3) number of non-zero coefficients, (4) number of meetings, (5) number of meeting types, (6) scheduling flexibility, (7) average duration of meetings, (8) number of meeting slots per day, (9) total number of meeting slots, (10)-(14) number of rooms in up to 5 building types, and (15)-(17) minimum, maximum, and average difference between outdoor temperature and temperature comfort bounds. These features reflect problem characteristics and are used by SMAC to estimate performance across instances and generate a set of new configurations.

Given a list of promising parameter configurations, SMAC compares them to the current configuration until a time limit is reached. Each time a promising configuration is compared to the current configuration, SMAC runs several problem instances until it decides that the promising configuration is empirically worse or at least as good as the current configuration. In the latter case the current configuration is updated. In the end, the configuration selected by SMAC is generalised to all problem instances in the training set.

A Numerical Example of LNS

FIG. 10(*a*) to (*c*) illustrate a numerical example of the LNS approach. This example results from four meeting requests made to a facility with four meeting rooms. For simplicity, the zone structure of the facility and parameters associated with the facility are not shown.

Initial Stage.

The LNS starts with an initial feasible solution by finding a feasible meeting schedule by minimizing the number of rooms occupied; and determining HVAC system control settings of supply air temperature and supply air flow rate to minimise energy consumption given a fixed schedule. This two-step stage achieves an initial solution in reasonable time.

FIG. 10(*a*) shows the initial meeting schedule and HVAC system control settings 1400. As indicated by the meeting schedule field 1401, all the meeting are to be held in room 2 and room 2 is available to the attendees at the time steps on 1 Jul. 2011: 13:00, 13:30, 14:00, 14:30, 15:30, 16:00, 16:30 and 17:00. The HVAC system control settings in each time step are shown in the HVAC operation field 1403. If the HVAC system operates according to the initial HVAC system control settings, the total energy consumption is 21.11 kWh. In this example, the total energy consumption is obtained by adding up all the energy consumption values in the energy consumption field 1405.

Destroy and Repair Stage.

2 to 4 rooms are randomly selected, and the meeting schedule and the HVAC system control settings in these rooms are destroyed. As a result, a MILP sub-problem is formed. By using the MILP, the meeting schedule and HVAC system control settings are repaired in these rooms. On the other hand, the meeting schedule and the HVAC system control settings in non-selected rooms are kept.

As shown in FIG. 10(*b*), rooms 1, 2 are selected, and all the meeting schedule and the HVAC system control settings are destroyed in rooms 1, 2. Then the meeting schedule and the HVAC system control settings in rooms 1, 2 are repaired by the MILP with the MILP runtime being limited to 15 minutes. As a result, all the meeting are moved to room 1 from room 2, and the room 1 available at time steps 9:00, 9:30, 10:00, 10:30, 11:00, 11:30, 12:00, 12:30. Using the meeting schedule and the HVAC system control settings 1500 shown in FIG. 10(*b*), the total energy consumption is 19.86 kWh, which is better than the initial meeting schedule and the HVAC system control settings shown in FIG. 10(*a*).

Repeat Destroy and Repair Stage.

Again, 2 to 4 rooms are randomly selected, and the meeting schedule and the HVAC system control settings in these rooms are destroyed. If an improved solution is found, then the new meeting schedule and the HVAC system control settings are accepted. Otherwise, the LNS approach reverts to the previous solution and repeats the destroy and repair stage until timeout, for example, two hours.

As shown in FIG. 10(*c*), rooms 1, 2, 3 are selected, and all the meeting schedule and the HVAC system control settings are destroyed in these rooms. Then, MILP is used to solve the MILP sub-problem for rooms 1, 2, 3 to repair the meeting schedule and the HVAC system control settings. As a result, a new meeting schedule and the HVAC system control settings are found, which indicates that the meetings are held in parallel in rooms 0, 2 at time steps 9:00, 9:30, 10:00, 10:30. Using the meeting schedule and the HVAC system control settings 1600 shown in FIG. 10(*c*), the total energy consumption is 19.18 kWh, which is better than the meeting schedule and the HVAC system control settings shown in FIG. 10(*b*).

LNS Performance

Figure 11:
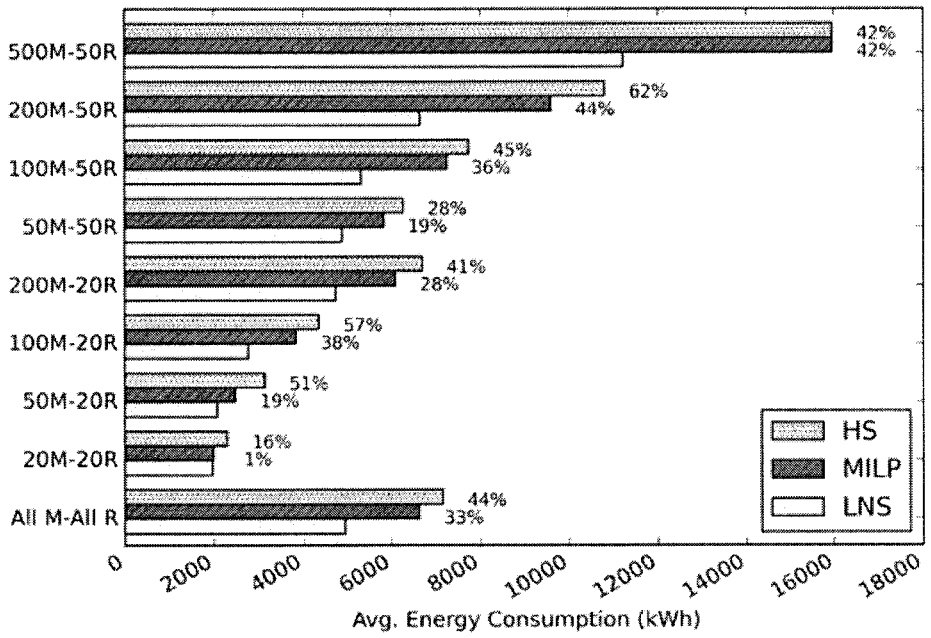
FIG. 11 illustrates an energy consumption comparison between LNS and other approaches.

FIG. 11 compares the average energy consumption obtained by LNS, MILP and the HS heuristic on 100 runs for each of 80 larger instances extracted from the PATAT dataset. These consist of 8 groups of 10 instances each, ranging from 20 to 500 1-1.5 h meetings to be scheduled in 20 to 50 rooms over the 5 days. For each run, both MILP and LNS were seeded with HS as the initial solution and were given the same run-time limit of 15 minutes. The percentages in FIG. 11 show the average excess consumption of MILP and HS, taking LNS as the baseline. The bottom bars give the average excess over all instances and runs. As shown in FIG. 11, LNS returns significantly better solutions on large problems.

Hardware Description

FIG. 12 illustrates an example schematic diagram of a computer system 1800 used to implement the method 200 described above with reference to the occupancy server 103.

The computer system 1800 includes a processor 1810, a memory 1820, a bus 1830, a communication interface 1840. The processor 1810, the memory 1820, the communication interface 1840 are connected through the bus 1830 to communicate with each other.

The processor 1810 performs machine executable instructions stored in an instruction unit 1821 of the memory 1820 to implement the method 200 described above. The machine executable instructions are included in a computer software program. The computer software program resides in the instruction unit 1821 in this example. In other examples, the computer software program is stored in a computer readable medium that is not part of the computer system 1800, and is read into the instruction unit 1821 of the memory 1820 from the computer readable medium. The memory 1820 also includes a model parameter unit 1821 that stores the parameters of the energy model described above.

The processor 1810 further includes an energy model unit 1811, a facility occupancy request unit 1813, and a decision unit 1815. The units 1811, 1813, 1815 of the processor 1810 are organised in a way as shown in FIG. 12 for illustration and description purposes only, and any other suitable arrangement can be used. Specifically, one or more units in the processor 1810 may be part of another unit. For example, the facility occupancy request unit 1813 may be integrated with the decision unit 1815. In another example, the decision unit 1815 in the processor 1810 may be separate from the processor 1810 without departing from the scope of the present disclosure.

The communication interface 1840 of the computer system 1800 is used to connect the computer system 1800 to the communication network 101, as shown in FIG. 1. The communication interface 1840 may be an Internet interface, a WLAN interface, a cellular telephone network interface, a Public Switch Telephone Network (PSTN) interface, and an optical communication network interface, or any other suitable communication interface.

The energy model unit 1811 of the processor 1810 obtains parameters of an energy model representing the energy consumed by the plurality of devices of the facility, the energy model including a first plurality of variables for operating the plurality of devices and a second plurality of variables for scheduling activities to be conducted in the facility. In this example, the energy unit 1811 obtains these parameters from the model parameter unit 1823 of the memory 1820.

The facility occupancy request unit 1813 receives requests from the user A, B, C for the activities to be conducted in the facility. As described above, the requests includes requirements in relation to the activities, for example: durations of the activities, one or more starting time windows, a set of allowable locations, a set of attendees, the number of the attendees, and identifications of the attendees.

The decision unit 1815 automatically determines, based on the energy model, values of the first plurality of variables to control the operation of the plurality of devices, and values of the second plurality of variables that meet the requirements in relation to the activities.

As described above, once the values of the variables of the energy model are determined, the computer system 1800 controls the operation of the plurality of devices according to the values of the first plurality of variables such that the energy consumed by the plurality of devices is minimised. Further, the computer system 1800 controls access to the facility according to the values of the second plurality of variables.

The memory 1820 stores other instructions, when performed by the processor 1810, causing the processor 1810 to implement other processes, for example, the LNS approach.

It should be understood that the techniques of the present disclosure might be implemented using a variety of technologies. For example, the methods described herein may be implemented by a series of computer executable instructions residing on a suitable computer readable medium. Suitable computer readable media may include volatile (e.g. RAM) and/or non-volatile (e.g. ROM, disk) memory, carrier waves and transmission media. Exemplary carrier waves may take the form of electrical, electromagnetic or optical signals conveying digital data streams along a local network or a publically accessible network such as the internet.

It should also be understood that, unless specifically stated otherwise as apparent from the following discussion, it is appreciated that throughout the description, discussions utilizing terms such as "receiving" or "obtaining" or "determining" or "sending" or "mapping" or the like, refer to the action and processes of a computer system, or similar electronic computing device, that processes and transforms data represented as physical (electronic) quantities within the computer system's registers and memories into other data similarly represented as physical quantities within the computer system memories or registers or other such information storage, transmission or display devices.

The invention claimed is:

1. A computer-implemented method for controlling operation of a plurality of devices of a facility that consume energy, the method comprising:

obtaining parameters of an energy model representing the energy consumed by the plurality of devices of the facility, the energy model including a first plurality of variables for operating the plurality of devices and a second plurality of variables for scheduling activities to be conducted in respective zones of the facility using the plurality of devices;

receiving requests for the activities to be conducted, the requests including requirements in relation to the activities;

minimizing the energy consumed as represented by the energy model by automatically determining output values that meet the requirements in relation to the activities that minimize the energy consumed as represented by the energy model, the output values comprising values of the first plurality of variables to control the operation of the plurality of devices and values of the second plurality of variables for scheduling activities to be conducted in the facility; and controlling operation of the plurality of devices according to the values of the first plurality of variables, the energy model comprising a mixed-integer program (MIP) for minimising the energy consumed, by steps comprising:

determining a feasible solution for scheduling the activities to be conducted and minimise the energy consumed for the feasible solution;

removing activities of randomly selected zones to create an energy aware MIP scheduling sub-problem that is smaller than the MIP problem;

solving the energy aware MIP scheduling sub-problem to determine a solution;

upon determining that the solution is an improved solution, accepting the solution; and upon determining that the solution is not an improved solution, keeping the removed activities.

2. The method according to claim 1, wherein: controlling the operation of the plurality of devices according to the values of the first plurality of variables minimizes the energy consumed by the plurality of devices.

3. The method according to claim 2, wherein controlling the operation of the plurality of devices comprises starting at least one of the plurality of devices prior to the activities to minimize the energy consumed by the plurality of devices.

4. The method according to claim 1, further comprising: controlling access to the facility according to the values of the second plurality of variables.

5. The method according to claim 1, wherein the energy model comprises a mixed-integer non-linear programming (MINLP) model.

6. The method according to claim 5, the wherein the energy model comprises a mixed-integer linear programming (MILP) model that is derived from the MINLP model.

7. The method according to claim 1, wherein determining the values of the first plurality of variables comprises determining one or more of air flow rates, and air temperatures supplied by the plurality of devices.

8. The method according to claim 1, wherein each of the requirements indicates one or more of the following in relation to one of the activities:

a duration;

one or more starting time windows;

one or more locations in the facility;

a quantity of attendees attending the activities; and identification of the attendees.

9. The method according to claim 8, wherein determining the values of the second plurality of variables comprises determining one or more of the following for the one of the activities:

a starting time within one of the one or more starting time windows; and one of the one or more locations.

10. The method according to claim 1, wherein determining the values of the first plurality of variables and the values of the second plurality of variables comprises determining the values of the first plurality of variables and the values of the second plurality of variables based on predetermined constraints on the activities.

11. The method according to claim 1, wherein the plurality of devices comprise one or more air conditioners, one or more ventilation devices and one or more air control units.

12. The method according to claim 11, wherein the parameters of the energy model comprise:

a heat capacity of air for the one or more air conditioners;

a ventilation coefficient of the one or more ventilation devices; and a predetermined temperature of air conditioned by the one or more air conditioners.

13. The method according to claim 11, wherein the parameters of the energy model further comprise:

a lower bound for an air flow rate supplied by the one or more air control units;

an upper bound for the air flow rate supplied by the one or more air control units;

for a location in the facility where one of the activities is to be conducted, a first lower bound for an air temperature supplied by the one or more air control units;

for a location in the facility where none of the activities is to be conducted, a second lower bound for the air temperature supplied by the one or more air control units;

for a location in the facility where one of the activities is to be conducted, a first upper bound for the air temperature supplied by the one or more air control units; and for a location in the facility where none of the activities is to be conducted, a second upper bound for the air temperature supplied by the one or more air control units.

14. The method according to claim 13, the parameters of the energy model further comprising thermal dynamics parameters of the facility.

15. A computer comprising a non-transitory machine-readable medium containing instructions, which, when executed by a machine, cause the machine to perform the method of claim 1.

16. A computer system for controlling operation of a plurality of devices of a facility that consume energy, the computer system comprising:

a memory to store instructions; and a processor to perform the instructions from the memory, comprising:

an energy model unit to obtain parameters of an energy model representing the energy consumed by the plurality of devices of the facility, the energy model including a first plurality of variables for operating the plurality of devices and a second plurality of variables for scheduling activities to be conducted in respective zones of the facility using the plurality of devices;

a facility occupancy request unit to receive requests for the activities to be conducted in the facility, the requests including requirements in relation to the activities; and a decision unit to minimize the energy consumed as represented by the energy model, by determining output values that meet the requirements in relation to the activities that minimize the energy consumed, as represented by the energy model, the output values comprising values of the first plurality of variables to control the operation of the plurality of devices, and values of the second plurality of variables for scheduling activities to be conducted in the facility;

wherein the computer system is configured to control the operation of the plurality of devices according to the values of the first plurality of variables, the energy model comprising a mixed-integer program (MIP) for minimising the energy consumed, by steps comprising:

determining a feasible solution for scheduling the activities to be conducted and minimise the energy consumed for the feasible solution;

removing activities of randomly selected zones to create an energy aware MIP scheduling sub-problem that is smaller than the MIP problem;

solving the energy aware MIP scheduling sub-problem to determine a solution;

upon determining that the solution is an improved solution, accepting the solution; and upon determining that the solution is not an improved solution, keeping the removed activities.

* * * * *